US008050584B2

(12) United States Patent
Chae et al.

(10) Patent No.: US 8,050,584 B2
(45) Date of Patent: Nov. 1, 2011

(54) POWER CONTROL METHOD AND APPARATUS TO HEAT A HEATING ROLLER

(75) Inventors: Young-min Chae, Suwon-si (KR); Sang-yong Han, Suwon-si (KR); Joong-gi Kwon, Gunpo-si (KR); Se-joong Kim, Seoul (KR); Jun-seok Cho, Gwangmyeong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/889,714

(22) Filed: Sep. 24, 2010

(65) Prior Publication Data

US 2011/0013922 A1 Jan. 20, 2011

Related U.S. Application Data

(62) Division of application No. 11/656,439, filed on Jan. 23, 2007, now Pat. No. 7,826,759.

(30) Foreign Application Priority Data

| | | |
|---|---|---|
| Jan. 24, 2006 | (KR) | 2006-7255 |
| Feb. 7, 2006 | (KR) | 2006-11778 |
| Feb. 10, 2006 | (KR) | 2006-12886 |
| Feb. 24, 2006 | (KR) | 2006-18427 |
| Mar. 14, 2006 | (KR) | 2006-23567 |

(51) Int. Cl.
*G03G 15/20* (2006.01)

(52) U.S. Cl. ..... 399/70

(58) Field of Classification Search ..... 399/67, 399/69, 70, 68; 219/216, 469–471
See application file for complete search history.

(56) References Cited

U.S. PATENT DOCUMENTS

| | | | | |
|---|---|---|---|---|
| 5,758,228 | A | 5/1998 | Hirose et al. | |
| 7,593,658 | B2 * | 9/2009 | Nishihara et al. | 399/69 |
| 7,826,759 | B2 * | 11/2010 | Chae et al. | 399/69 |

(Continued)

FOREIGN PATENT DOCUMENTS

| | | |
|---|---|---|
| GB | 2321319 | 7/1998 |

(Continued)

OTHER PUBLICATIONS

European Search Report dated Jun. 4, 2007 issued in European Patent Application No. 07101095.3.

(Continued)

*Primary Examiner* — Susan Lee
(74) *Attorney, Agent, or Firm* — Stanzione & Kim, LLP

(57) ABSTRACT

A power control apparatus includes a heating roller provided to fix a toner image of print data in an image forming apparatus, the heating roller having a heating resistor to receive roller power. A maximum level of a source power supplied from an external source is gradually increased up to a specific maximum supply level and the maximum source power to the heating resistor is supplied as the roller power while gradually increasing the maximum level of the source power up to a specific maximum supply level. A surface temperature of the heating roller is measured, and the source power of which maximum level is equal to the maximum supply level is supplied to the heating resistor as the roller power until the measured surface temperature reaches a specific fixing target temperature, and the toner image is fixed onto a fed printing medium.

20 Claims, 14 Drawing Sheets

U.S. PATENT DOCUMENTS

| | | | | |
|---|---|---|---|---|
| 7,885,567 | B2 * | 2/2011 | Na et al. | 399/69 |
| 2003/0178410 | A1 | 9/2003 | Satoh | |
| 2004/0151516 | A1 | 8/2004 | Takahashi et al. | |
| 2007/0189796 | A1 * | 8/2007 | Chae et al. | 399/69 |
| 2009/0297198 | A1 * | 12/2009 | Nanataki et al. | 399/69 |

FOREIGN PATENT DOCUMENTS

| | | |
|---|---|---|
| JP | 05-224559 | 9/1993 |
| JP | 10-254274 | 9/1998 |
| JP | 10-301441 | 11/1998 |
| JP | 11-233235 | 8/1999 |
| JP | 11-272113 | 10/1999 |
| JP | 2002-63981 | 2/2002 |
| JP | 2004-325739 | 4/2003 |
| JP | 2003-332039 | 11/2003 |
| JP | 2004-078146 | 3/2004 |
| JP | 2004-240250 | 8/2004 |
| JP | 2004-252432 | 9/2004 |
| JP | 2005-091965 | 4/2005 |
| JP | 2005-128200 | 5/2005 |
| JP | 2005-156843 | 6/2005 |
| JP | 2005-258036 | 9/2005 |
| JP | 2005-258346 | 9/2005 |
| KR | 2002-63663 | 8/2002 |

OTHER PUBLICATIONS

Korean Office Action dated May 29, 2008 issued in KR 2006-23567.
Japanese Non-Final Rejection issued May 10, 2011 in JP Application No. 2007-014297.

* cited by examiner

FIG. 9A
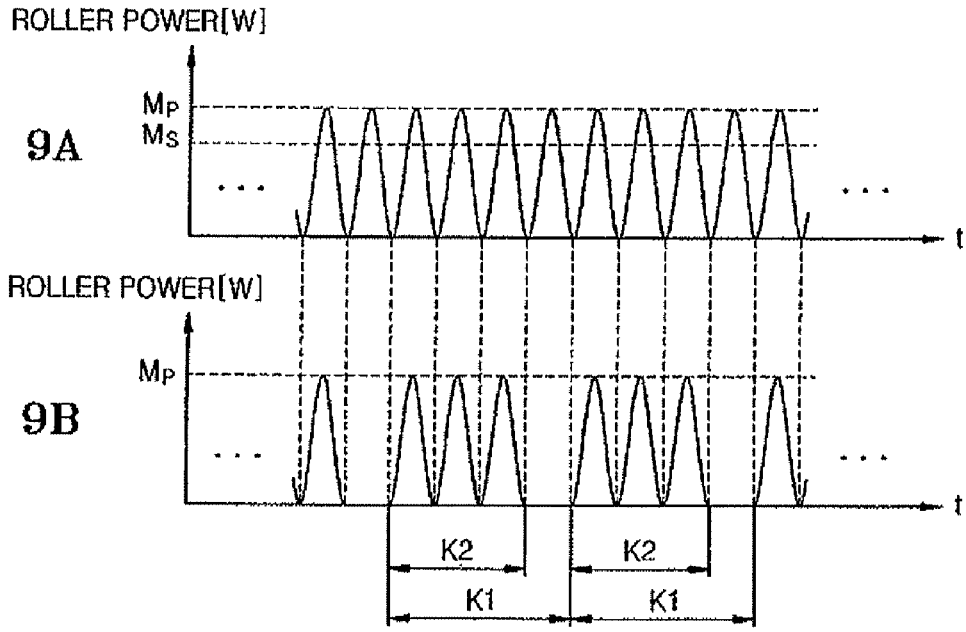
FIG. 9B
FIG. 10
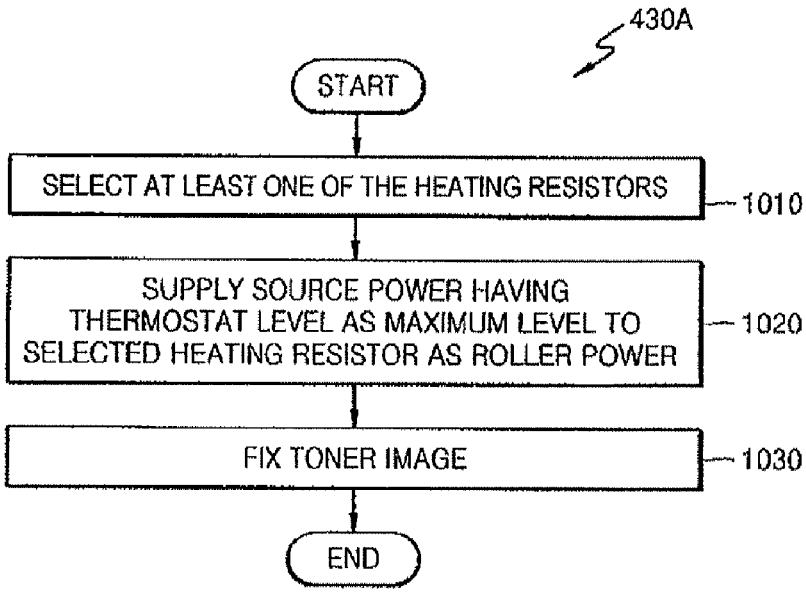

POWER CONTROL METHOD AND APPARATUS TO HEAT A HEATING ROLLER

CROSS-REFERENCE TO RELATED APPLICATIONS

This application is a divisional application of Ser. No. 11/656,439, filed on Jan. 23, 2007 now U.S. Pat. No.7,826,759, which claims the benefit of Korean Patent Application Nos. 10-2006-0007255 filed on Jan. 24, 2006, 10-2006-0011778 filed on Feb. 7, 2006, 10-2006-0012886 filed on Feb. 10, 2006, 10-2006-0018427 filed on Feb. 24, 2006, and 10-2006-0023567 filed on Mar. 14, 2006, in the Korean Intellectual Property Office, the disclosures of each of which are incorporated herein by reference in their entirety.

BACKGROUND OF THE INVENTION

1. Field of the Invention

The present general inventive concept relates to a heating roller (HR) used to fix a toner image, and more particularly, to a power control method and apparatus to supply an external source power to a heating resistor included in a heating roller to heat the heating roller in an image forming apparatus.

2. Description of the Related Art

In an image forming apparatus, such as a printer or a copy machine, which forms an image of print data on a printing medium by using a developing material such as toner, a toner image corresponding to the print data is fixed onto the printing medium, and the printing medium is then discharged out of the image forming apparatus, thereby obtaining printed matter.

The image forming apparatus may use a heating roller having heating resistors. In this case, in order to perform a fixing operation, a surface temperature of the heating roller has to be maintained around a fixing target temperature, for example, 180° C.

The image forming apparatus is switched to a print mode when the image forming apparatus receives a printing order after power is turned on, or when the image forming apparatus receives the printing order in a standby mode. Here, a time required after the printing order is received and before a first printed matter is discharged is referred to as a first print out time (FPOT).

In order to reduce the FPOT of the image forming apparatus including the heating roller, the surface temperature of the heating roller has to more rapidly reach the fixing target temperature. The heating resistor may be made of tungsten, and may have a variable characteristic in which a resistance thereof is determined in proportion to a heating resistor's temperature equal to or less than a threshold temperature.

FIGS. 1A and 1B are waveform diagrams illustrating a power control principle of a conventional heating roller. Referring to FIGS. 1A and 1B, a voltage (Vin) 110 illustrated is applied to a heating resistor from an external source, causing a current (Ir) 120 to flow through the heating resistor. Further, the current (Ir) 120 is gradually decreased until a heating roller's temperature reaches a threshold temperature. The power control principle of the conventional heating roller has a drawback in that a circuit may be damaged due to an excessive current that may flow through the heating resistor when power is initially or suddenly supplied to the heating roller. In this case, a high current may flow through the heating resistor in the form of an alternating current, thereby exhibiting a deteriorating flicker characteristic. The flicker characteristic is defined as a phenomenon in which power supplied to a peripheral circuit is temporarily weakened.

A threshold resistance of a heating resistor at a threshold temperature (of the heating roller) is intrinsically determined. Here, the lower the threshold resistance, the higher the amount of power that can be supplied through to the heating resistor. Thus, the surface temperature of the heating roller can be rapidly increased. However, when a heating resistor having a lower threshold resistance is used, a higher current flows through the heating resistor when power begins to flow through the heating resistor, thereby causing the aforementioned problems. Eventually, according to the conventional power control principle to rapidly heat a heating roller, a heating resistor has to have a sufficiently low threshold resistance. Thus, due (in part) to the deteriorating flicker characteristic, there has been a limit in reducing a time required to increase a surface temperature of the heating roller up to a fixing target temperature $ST_t$.

Furthermore, if the conventional image forming apparatus receives a printing order after the image forming apparatus is turned on, the heating roller can be heated only after a control unit (not illustrated) which controls overall tasks performed in the image forming apparatus, for example, a central processing unit (CPU) of the image forming apparatus, is initialized. Therefore, the aforementioned problem that there is a limit in reducing a warm-up time to print becomes more pronounced when the conventional image forming apparatus receives the printing order before the control unit (not illustrated) is initialized.

SUMMARY OF THE INVENTION

The present general inventive concept provides a power control method in which, when the image forming apparatus is turned on, a heating roller can be heated before the image forming apparatus is fully initialized, and power can be supplied to the heating roller in such a way that the power is gradually increased at an early stage and a maximum power is provided after a specific elapsed time, so that a flicker characteristic can be reduced or avoided, and a surface temperature of the heating roller can rapidly reach the fixing target temperature.

The present general inventive concept also provides a power control apparatus to heat a heating roller according to a power control method.

The present general inventive concept also provides a computer-readable medium having embodied thereon a computer program to execute a power control method.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept can be achieved by providing a power control method of controlling a heating roller, in which a roller power supplied to a heating resistor included in the heating roller is controlled in an image forming apparatus using the heating roller and fixing a toner image, the power control method including gradually increasing a maximum level of a source power supplied from an external source up to a specific maximum supply level, and supplying the source power at the maximum level to the heating resistor, measuring a surface temperature of the heating roller, and further supplying the source power of which maximum level is equal to the maximum supply level to the heating resistor as the roller power until the measured surface temperature reaches a specific fixing target temperature, and fixing a toner image of print data on a printing medium by using the heating roller.

The foregoing and/or other aspects and utilities of the present general inventive concept can be achieved by providing a power control apparatus to execute a power control method, the power control apparatus including a power supply unit to gradually increase the maximum level of the source power in response to a first or second warm-up indication signal, and to output the source power to the heating resistor of the heating roller as the roller power, to output the source power of which maximum level is equal to a maximum supply level to the heating resistor as the roller power in response to a third warm-up indication signal, and to output the source power of which maximum level is equal to a thermostat level to the heating resistor (as the roller power) in response to a fixing indication signal, a temperature measuring unit to measure a surface temperature of the heating roller in response to the third warm-up indication signal and to output the measured surface temperature, a toner fixing unit to fix the toner image onto the fed printing medium by using the heating roller in response to the fixing indication signal, a first comparing unit to compare the increased maximum level (that is input from the power supply unit) with the maximum supply level, and to generate the second or third warm-up indication signal according to the comparison result, and a second comparing unit to compare the measured surface temperature with the fixing target temperature, and to generate the third warm-up indication signal and the fixing indication signal.

The foregoing and/or other aspects and utilities of the present general inventive concept can be achieved by providing a computer-readable medium having embodied thereon a computer program to execute a power control method of heating a heating roller, in which a roller power supplied to a heating resistor included in the heating roller is controlled in an image forming apparatus using the heating roller and fixing a toner image, the power control method including gradually increasing a maximum level of a source power supplied from an external source up to a specific maximum supply level, and supplying the source power at the maximum level to the heating resistor as the roller power, measuring a surface temperature of the heating roller, and supplying the source power of which maximum level is equal to a maximum supply level to the heating resistor (as the roller power) until the measured surface temperature reaches a specific fixing target temperature, and fixing the toner image of print data onto the fed printing medium by using the heating roller.

The foregoing and/or other aspects and utilities of the present general inventive concept can be achieved by providing a power control apparatus usable in an image forming apparatus may be provided including a non-heating control unit to control non-heating control components according to a power-on signal, and a heating control unit to increase a level of a source power supplied as roller power and to supply the increased level of the roller power to a heating roller according to phases of current of the source power such that heating the roller reaches a temperature before a power-on process of the non-heating control unit is completed.

The foregoing and/or other aspects and utilities of the present general inventive concept can be achieved by providing an image forming apparatus may be provided including a non-heating control unit to initialize a power-on process to control non-heating control components to feed a printing medium to fix a toner image onto the printing medium, and a heating control unit to supply a source power to a heating roller such that, in conjunction with the non-heating control components, the image is fixed onto the printing medium, the source power varying from a level to a maximum supply level according to a non-zero section of a current of the source power in a flicker characteristic improving section, and to maintain the source power at the maximum supply level according to a maximum power supplying section such that a temperature of the heating roller reaches a predetermined temperature before the initializing of the non-heating control unit power-on process is completed.

A method of operating an image forming apparatus may be provided, the method including supplying source power to a heating roller using a heating control unit generating a gradually variable level of the source power adjusted to a maximum supply level according to a synchronization signal of a current of the source power such that a temperature of the heating roller reaches a fixing-ready temperature before a non-heating control unit completes initialization of a power-on process.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIGS. 9A and 9B are waveform diagrams corresponding to an operation of a power control method illustrated in FIG. 8;

FIG. 10 is a flowchart illustrating an operation of a power control method according to an embodiment of the present general inventive concept;

DETAILED DESCRIPTION OF THE PREFERRED EMBODIMENTS

Figures 1A, 1B:
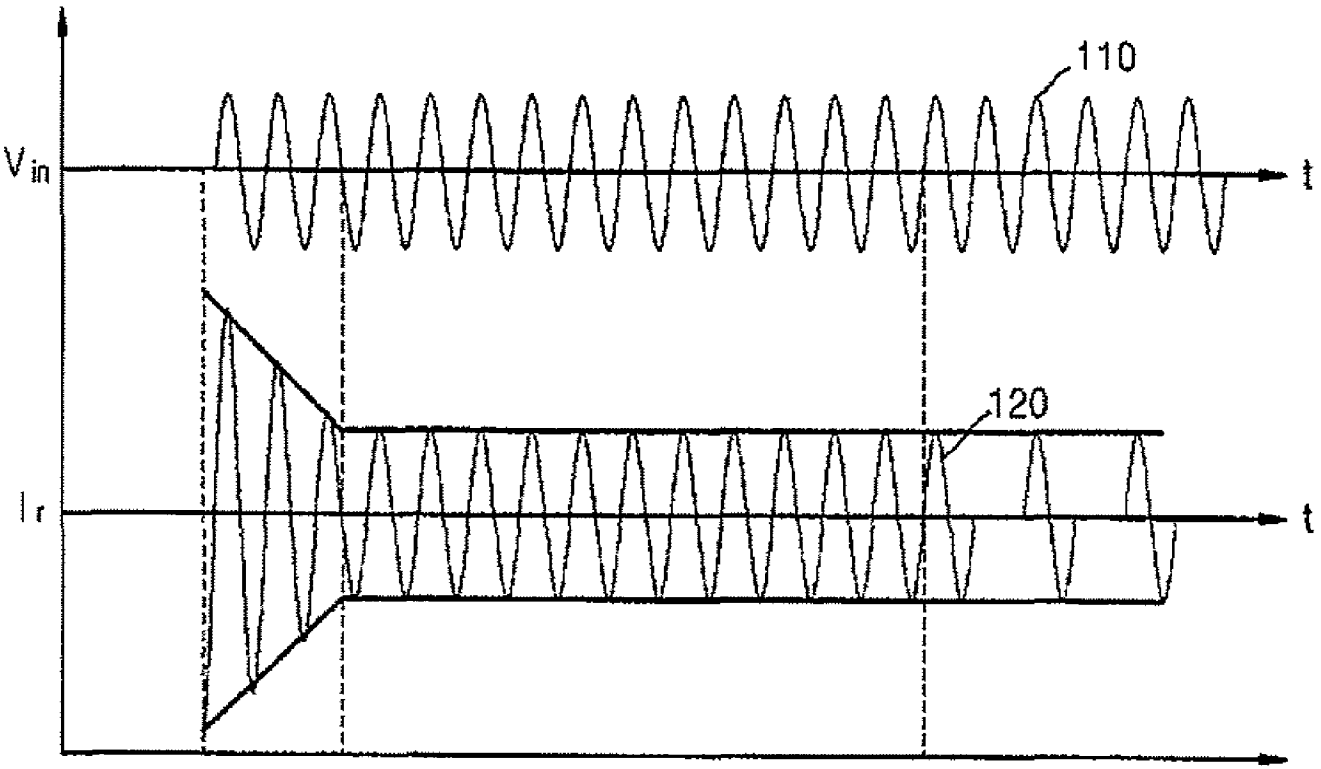
FIG. 1A (PRIOR ART)
FIG. 1B (PRIOR ART)
FIGS. 1A and 1B are waveform diagrams illustrating a power control principle of a conventional heating roller.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
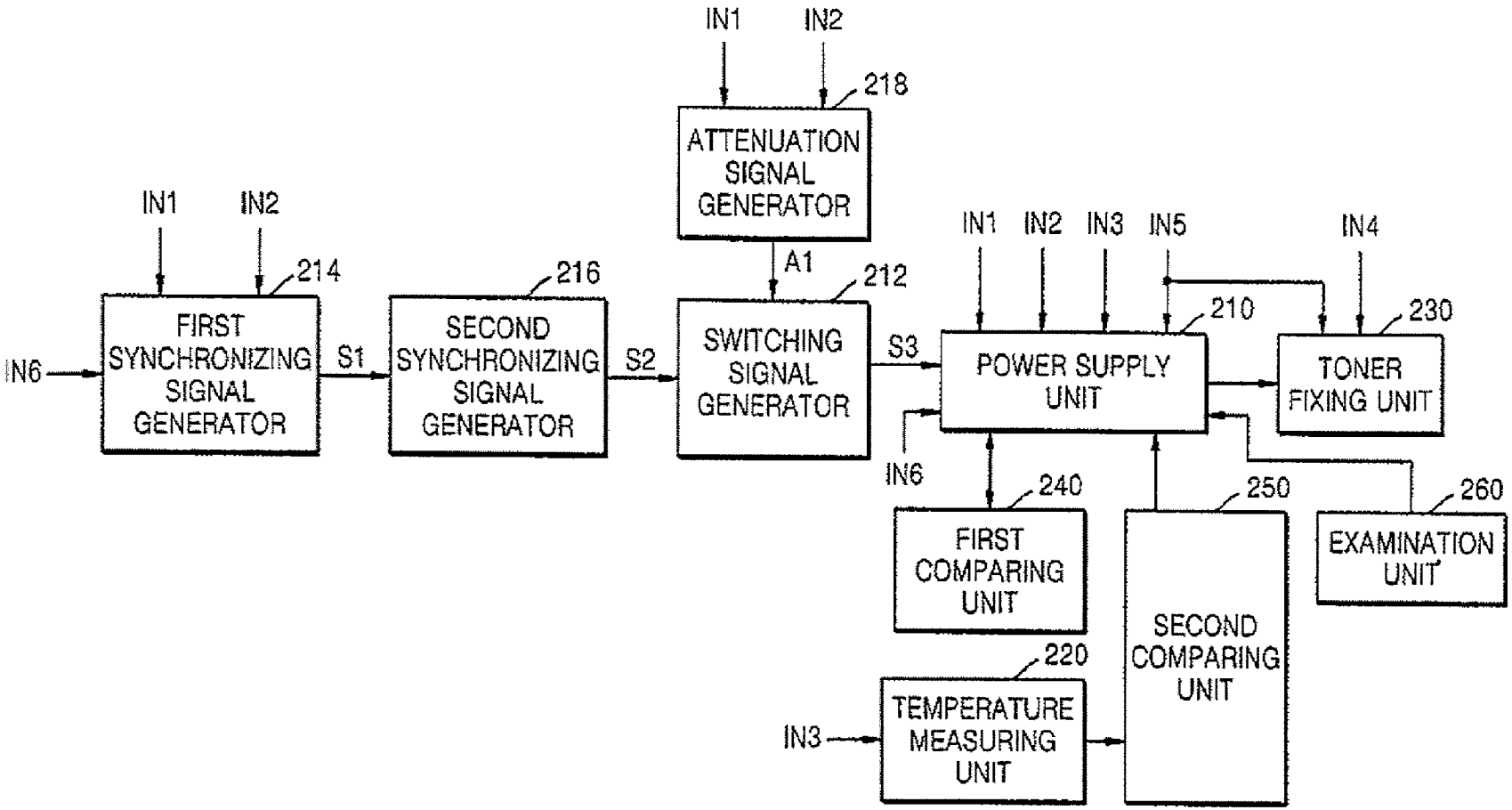
FIG. 2 is a block diagram illustrating a power control apparatus to heat a heating roller according to an embodiment of the present general inventive concept.

FIG. 2 is a block diagram illustrating a power control apparatus to heat a heating roller according to an embodiment of the present general inventive concept. The power control apparatus can include a power supply unit 210, a switching signal generator 212, a first synchronizing signal generator 214, a second synchronizing signal generator 216, an attenuation signal generator 218, a temperature measuring unit 220, a toner fixing unit 230, a first comparing unit 240, a second comparing unit 250, and an examination unit 260. However, the switching signal generator 212, the first synchronizing signal generator 214, the second synchronizing generator 216, the attenuation signal generator 218, and the examination unit 260 may not be disposed in the power control apparatus according to an embodiment of the present general inventive concept.

All of the above components 210, 220, 230, 240, 250 and 260 of FIG. 2 can be provided in an image forming apparatus to fix a toner image using the heating roller. For example, such components may be provided in a fixing system of a laser printer or a copy machine.

According to an embodiment of the present general inventive concept, the image forming apparatus can include a heating roller having one or more lamps. Each lamp can include a heating resistor. The heating resistor can be made of tungsten, and may have a variable resistance thereof which is in proportion to (or in inverse proportion to) a heating resistor's temperature at or below a threshold temperature. When the resistance is variable in proportion to the heating resistor's temperature at or below a threshold temperature, the heating resistor may have a positive temperature coefficient (PTC) characteristic. For convenience, it will be assumed that the heating resistor has the PTC characteristic. Although, a heating resistor with negative temperature coefficient (NTC) may be used by one skilled in the art together with the present disclosure.

A plurality of lamps may be included in the heating roller, to provide a plurality of heating resistors, which may be connected in parallel. A roller power that is supplied to the respective heating resistors may be controlled independently to heat the heating roller.

The roller power can be supplied to the heating resistor in the form of an alternating current (AC), according to an AC roller input voltage. Here, the roller voltage represents a voltage applied to the heating resistor, and the roller current represents a current flowing through the heating resistor.

The power supply unit 210 outputs a source power supplied from an external source while gradually increasing a maximum level of the source power supplied to the heating resistor as the roller power in response to "a first warm-up indication signal and a switching signal" or "a second warm-up indication signal and a switching signal". More specifically, the power supply unit 210 outputs the source power to the heating resistor as the roller power at a non-zero signal section of the switching signal, so that the non-zero signal section is gradually increased.

Meanwhile, if the first synchronizing signal generator 214, the second synchronizing signal generator 216, and the attenuation signal generator 218 may not be disposed in the power control apparatus according to an embodiment of the present general inventive concept, the power supply unit 210 can output the source power while gradually increasing the maximum level of the source power to the heating resistor as the roller power in response to the first warm-up indication signal or the second warm-up indication signal.

Further, the power supply unit 210 can output the source power to the heating resistor as the roller power in response to a third warm-up indication signal or a fixing indication signal.

In addition, the power supply unit 210 outputs no power to the heating resistor as the roller power in response to a power supply interruption signal. That is, the power output from the power supply unit 210 may be interrupted, stopped, or not provided according to the power supply interruption signal.

Here, the external source represents a source outside the heating resistor, in particular, outside the power supply unit 210. In addition, the source power represents power that is input to the power supply unit 210. In addition, the roller power represents power that is supplied to the heating resistor via the power supply unit 210.

The switching signal generator 212, the first synchronizing signal generator 214, the second synchronizing signal generator 216, and the attenuation signal generator 218 operate to generate a switching signal. More specifically, certain operations of the aforementioned elements 212 to 218 are explained as follows.

Figures 6A, 6B, 6C, 6D, 6E:
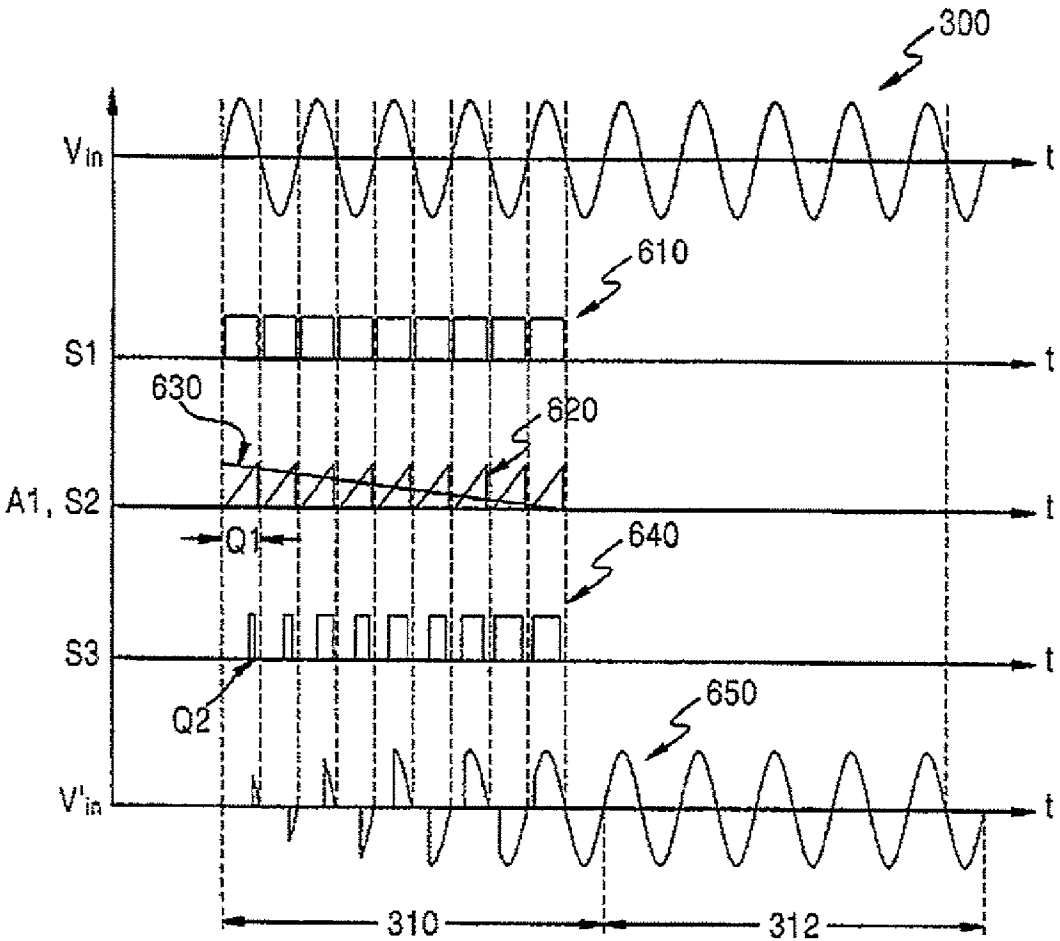
FIGS. 6A, 6B, 6C, 6D and 6E are waveform diagrams corresponding to the flowchart illustrated in FIG. 5.

The switching signal generator 212 generates the switching signal having a rectangular waveform having a non-zero signal section generated when an attenuation signal Al is equal to or less than a second synchronizing signal S2, as illustrated in FIGS. 6C and 6D. To generate the second synchronizing signal S2, the power control apparatus, according to an embodiment of the present general inventive concept, requires the first synchronizing signal generator 214 and the second synchronizing signal generator 216.

The first synchronizing signal generator 214 generates a first synchronizing signal S1 having a rectangular waveform synchronized with the source power in response to the first or second warm-up indication signal, as illustrated in FIG. 6B.

In addition, the second synchronizing signal generator 216 integrates the first synchronizing signal S1 and outputs the integration result as the second synchronizing signal S2. The second synchronizing signal generator 216 can be embodied as an integrator including one or more resistors (not illustrated) and a capacitor (not illustrated). Accordingly, the second synchronizing signal S2 may have a triangle waveform such as a saw tooth wave, as illustrated in FIG. 6C.

Meanwhile, the attenuation signal generator 218 generates an attenuation signal A1 attenuating at a predetermined slope in response to the first or second warm-up indication signal, as illustrated in FIG. 6C. The slope of the attenuation signal A1 may be set up so that the attenuation signal A1 enters a zero signal section before the second comparing unit 250 generates a subsequent third warm-up indication signal.

The temperature measuring unit 220 measures a surface temperature of the heating roller in response to the third warm-up indication signal, and outputs the measured surface temperature.

The toner fixing unit 230 may have the heating roller and a pressure roller. Herein, the pressure roller may have a heating resistor like the heating roller. Also, the pressure roller may not include a heating resistor. The fixing of the toner image may be performed when the surface temperature of the heating roller is at (or at about) a fixing target temperature. It is possible that the surface temperature of the pressure roller as well as the surface temperature of the heating roller is at the fixing target temperature.

When the pressure roller does not include the heating resistor, the pressure roller may heat up by absorbing heat from heating objects (or components) in contact with (or adequately near) the pressure roller, or by extracting heat from the heating roller while co-rotating with the heating roller before actually performing (or conducting) fixing.

To facilitate description, hereinafter it is assumed that the pressure roller heats up by extracting the heat from the heating roller while co-rotating with the heating roller before performing fixing. However, the pressure roller may be heated by heat from other heat sources.

As noted above, where the pressure roller extracts heat from the heating roller, the pressure roller rotates (or operates) in conjunction with the heating roller in the toner fixing unit 230 which operates in response to a fourth warm-up indication signal. Further, the toner image of print data formed in the image forming apparatus is fixed onto a prepared printing medium by using the heating roller and the pressure roller, when the printing medium is timely fed between these rollers (heating roller and pressure roller) in part in response to a fixing indication signal. Herein, the operation (or rotation) of the pressure roller in conjunction with the heating roller (or vice versa) means that these rollers rotate against each other (with or without the printing medium between them) as appropriate. In addition, the print data to be fixed may be on one or more pages of the printing medium.

Specifically, the pressure roller operates (or rotates) in conjunction with the heating roller in and (or by) the toner fixing unit 230 which operates in response to a fourth warm-up indication signal. Accordingly, the surface temperature of the pressure roller as well as the surface temperature of the heating roller is adjusted to the fixing target temperature.

Meanwhile, the printing medium is timely fed between the co-rotating heating roller and pressure roller in response to the fixing indication signal. In this case, co-rotating of the heating roller in conjunction with the pressure roller together with coordinated (and timely) feeding of the printing medium therebetween is performed (in part) in response to the fixing indication signal. Accordingly, the toner image is fixed on the printing medium while the heating roller and the pressure roller co-rotate in conjunction with each other. Once the toner image has been fixed on the printing medium, the printing medium is then outputted by the image forming apparatus.

The first to fourth warm-up indication signals, the fixing indication signal, and the source power described above are each input through one or more of input nodes IN1, IN2, IN3, IN4, IN5 and IN6, as illustrated in FIG. 2.

Figure 15:
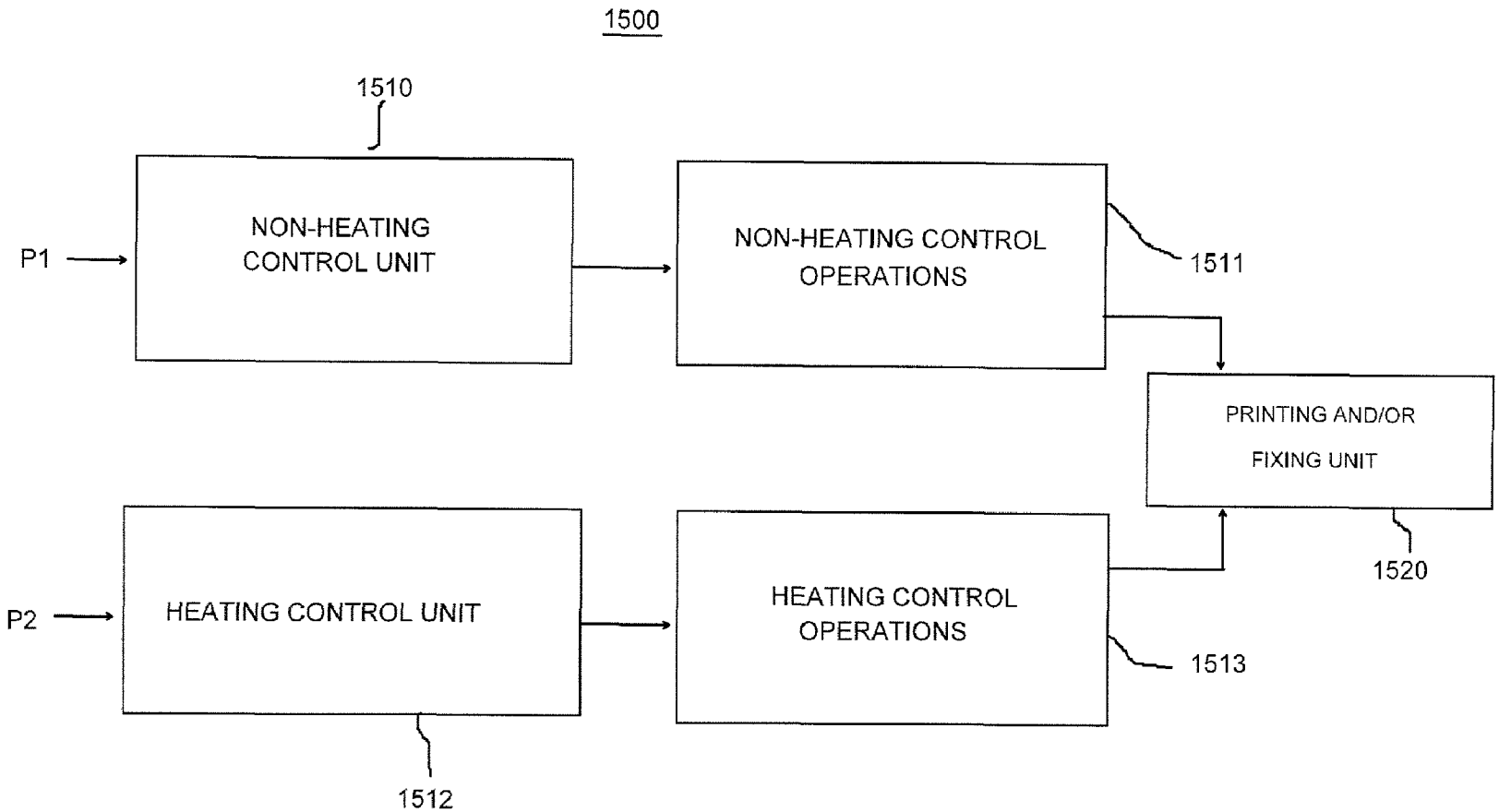
FIG. 15 illustrates an image forming apparatus with various control units to control heating and non-heating control operations according to an embodiment of the present general inventive concept.

FIG. 15 illustrates an image forming apparatus 1500 including a non-heating control unit 1510 to control non-heating control operations 1511 and a heating control unit 1512 to control heating control operations 1513. The non-heating control unit 1510 may be a CPU. The power control apparatus of FIG. 2 may be included in the image forming apparatus 1500.

The first warm-up indication signal represents a signal which allows the power supply unit 210 to supply source power to the heating resistor (as roller power) while gradually increasing the maximum level of source power up to a maximum supply level. The first warm-up indication signal is generated right after the image forming apparatus is turned on, or right after the image forming apparatus is switched from a stand-by mode to a print mode. To achieve this, a control unit (hereinafter referred to as a 'heating control unit'), which controls operations related to heating in the image forming apparatus, and a control unit (hereinafter referred to as a 'non-heating control unit'), which controls every other necessary operation in the image forming apparatus except for heating-related operations (hereinafter referred to as 'operations not-related to heating'), can be separately provided in the image forming apparatus. The first warm-up indication signal can be generated by the heating control unit.

As an example, the heating control unit recognizes the heating roller and/or controls heating of the heating roller. Here, the heating roller is recognized while initializing the heating control unit, and the initialization time of the heating control unit is adjusted to be negligible. On the other hand, for example, the non-heating control unit recognizes a pressure roller, and/or controls driving rotation of the heating roller in conjunction with the pressure roller. The non-heating control unit may also control a laser scanning unit (LSU) included in the image forming apparatus. The pressure roller is recognized (by the non-heating control unit) while the non-heating control unit is initializing. The initialization time of the non-heating control unit is considerably longer than that of the heating control unit. Finally, when the image forming apparatus is powered on, the heating control unit may immediately (or nearly immediately) begin to heat the heating roller. For example, the heating control unit begins to heat the heating roller right after completing its initialization requiring negligible initialization time. However, it takes some time, for example, several seconds, to initialize the non-heating control unit. Therefore the heating roller is already in a heated state by the time the initialization of the non-heating control unit is completed.

The non-heating control unit may be a central processing unit (CPU) of the image forming apparatus. The CPU can control necessary operations of the image forming apparatus (to fix the toner image on the printing medium), except for the heating-related operations.

The control unit of the image forming apparatus of FIG. 15 can include the heating control unit and the non-heating control unit. When the image forming apparatus is turned on, the image forming apparatus can start to perform a heating operation to heat the heating roller before the CPU has been fully initialized. Such design is different from a conventional control apparatus of an image forming apparatus where the heating-related operations cannot be started until the CPU is fully initialized.

The heating control unit and the non-heating control unit may be provided in include hardware and/or software form.

The second warm-up indication signal represents a signal which allows the power supply unit 210 to supply source power to the heating resistor as roller power while gradually increasing the maximum level of source power up to a maximum supply level. The second warm-up signal is generated by the first comparing unit 240.

The third warm-up signal represents a signal which allows the power supply unit 210 to supply source power of which maximum level is equal to the maximum supply level to the heating resistor as the roller power. The third warm-up indication signal is generated by the first comparing unit 240 or the second comparing unit 250.

The fourth warm-up indication signal represents a signal which allows the toner fixing unit 230 to rotate (or operate) the heating roller in conjunction with the pressure roller. The fourth warm-up indication signal is generated by the non-heating controller after the non-heating controller recognizes (or initializes) the pressure roller. In particular, the fourth warm-up indication signal may be generated right after the non-heating controller recognizes the pressure roller. The fixing indication signal represents a signal which allows the power supply unit 210 to supply a source power (the maximum level is equal to a thermostat level) to the heating resistor (as the roller power). The fixing indication signal can also represent a signal which allows the toner fixing unit 230 to timely feed the printing medium between the heating roller and the pressure roller to allow the toner fixing unit 230 to fix the toner image onto the fed printing medium. The fixing indication signal may be generated by the second comparing unit 250, or may be generated by the non-heating control unit (not illustrated) while fixing is performed.

Hereinafter, the principle of generating the second and third warm-up indication signals, the power supply interruption signal, and the fixing indication signal will be described along with operations of the first comparing unit 240, the second comparing unit 250, and the examination unit 260.

The first comparing unit 240 compares the maximum level of source power (that is gradually increased) against a predetermined maximum supply level, and generates the second warm-up indication signal or the third warm-up indication signal according to the comparison result obtained by the first comparing unit 240. The maximum supply level is the largest maximum level of roller power that can be supplied to the heating resistor. Typically, the source power is supplied to the heating resistor at the maximum level which is being gradually increased up to the maximum supply level. The gradually increasing amounts of source power are supplied to the heating resistor (or to more than one heating resistor, or to more than one selected heating resistors, if multiple heating resistors are provided in the heating roller), for example.

Specifically, if the increased maximum level of the source power supplied is less than the maximum supply level, the first comparing unit 240 generates the second warm-up indication signal. On the other hand, if the maximum level of source power supplied equals the maximum supply level, the first comparing unit 240 generates the third warm-up indication signal.

The second comparing unit 250 compares a surface temperature (of the heating roller) measured by the temperature measuring unit 220 with a fixing target temperature, (for example, 180° C.) and generates the third warm-up indication signal or the fixing indication signal according to the comparison result obtained by the second comparing unit 250. The fixing target temperature represents a surface temperature of the heating roller at which a toner image can be fixed in a stable manner. The toner image can be fixed in a stable manner when the surface temperature is a temperature that may be any temperature in the range of a specific minimum fixable temperature and a specific maximum fixable temperature. The surface temperature may be the minimum fixable temperature, the maximum fixable temperature or any value in between the minimum and maximum fixable temperatures and still be sufficient to provide fixing of the toner on the printing medium in a stable manner. The fixing target temperature is predetermined in the range of the minimum fixable temperature and the maximum fixable temperature. Sufficient source power to stably fix the toner image is provided when the heating roller is at the fixing target temperature (or at or within a suitable range thereof to stably fix the toner image).

Specifically, if the surface temperature measured by the temperature measuring unit 220 is less than the fixing target temperature, the second comparing unit 250 generates the third warm-up indication signal. On the other hand, if the surface temperature measured by the temperature measuring unit 220 equals the fixing target temperature (or is between or at the minimum or maximum fixing temperatures), the second comparing unit 250 generates the fixing indication signal.

Figure 13A:
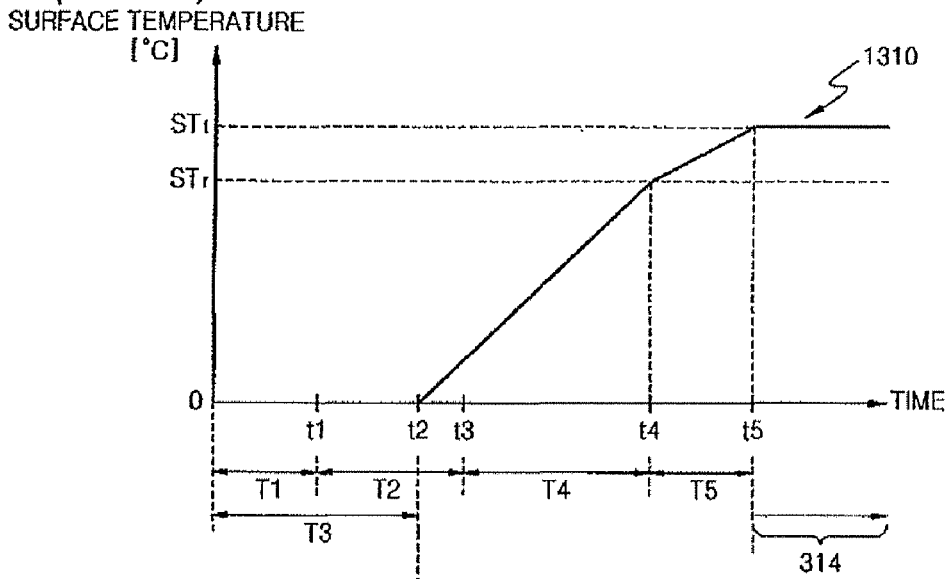
FIG. 13A (PRIOR ART)
FIG. 13A is a plot illustrating a surface temperature of a heating roller according to a conventional power control method.
Figure 13B:
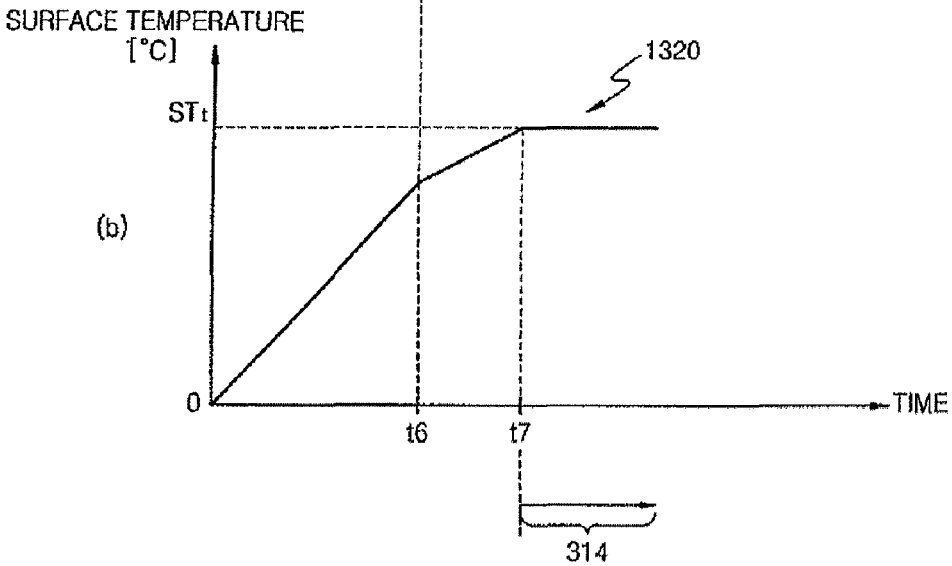
FIG. 13B is a plot of surface temperature of a heating roller versus time corresponding to the process of FIG. 11.

In addition, the second comparing unit 250 can compare the maximum supply level with a specific maximal rated level, and generate the third warm-up indication signal intermittently based on the comparison result. Here, the maximal rated level relates to the maximum level (of rated power) which can be supplied to the heating resistor to heat the heating roller. Specifically, the second comparing unit 250 may calculate the degree to which the maximum supply level exceeds the maximal rated level, and intermittently generate the third warm-up indication signal based on the calculated result. More specifically, referring to FIGS. 9A and 9B for example, the second comparing unit 250 may calculate a fourth predetermined time K2 which is inversely proportional to the calculated result, and generate the third warm-up indication signal during the fourth predetermined time K2 during every period designated as the third predetermined time K1. Here, the fourth predetermined time K2 is equal to or shorter than the third predetermined time K1. The fourth predetermined time K2 is determined (or calculated) so that a rate of increase in the surface temperature of the heating roller (being supplied with the source power as roller power having as its upper limit the maximum supply level) is greater when the heating roller is not in contact with the pressure roller (or when the heating roller is not supplying more than a negligible amount of heat to the pressure roller). Thus, the rate of temperature increase of the heating roller when in contact with the pressure roller may be 90% (or other value less than 100%) of the temperature increase rate when not in contact with the pressure roller, as illustrated in FIG. 13B (slope between t=0 and t=t6 is greater than slope between t=t6 and t=t7, for example).

The second comparing unit 250 compares the maximum supply level with the maximal rated level. If the measured surface temperature is determined to be lower than the fixing target temperature, the fourth predetermined time K2 may be increased to intermittently generate the third warm-up indication signal, sufficient to reach the fixing target temperature. However, if the maximum supply level is determined to exceed the maximal rated level, the second comparing unit 250 calculates the fourth predetermined time K2 to be in inverse proportion to the excess value. So, if the maximum supply level exceeds the maximal rated level by a larger (e.g., percentage) amount, then the corresponding fourth predetermined time K2 is reduced. If, on the other hand, the maximum supply level exceeds the maximal rated level by a smaller (e.g., percentage) amount, then the fourth predetermined time K2 is correspondingly increased, for example.

Meanwhile, the examination unit 260 examines whether the image forming apparatus is instructed to print the print data and whether the roller power is being adequately (or sufficiently) supplied (to stably fix the toner image) to the heating resistor normally. If inadequate (or insufficient) roller power is being supplied (to fix the toner image), the examination unit 260 generates the power supply interruption signal in response to such examination result to prevent or interrupt fixing. The examination unit 260 may operate in response to the first, second, or third warm-up indication signal and an initializing completion indicating signal. Here, the initializing completion indicating signal is a signal representing completion of the initialization of the non-heating control unit (not illustrated). The initializing completion indicating signal may be continuously generated by the non-heating control unit (not illustrated), when (and/or after) the initialization of the non-heating control unit is completed.

Specifically, if it is determined by the examination unit 260 that the image forming apparatus is not instructed to print the print data or that the roller power (source power supplied to the heating roller or heating resistor) is inadequately (or insufficiently) supplied (i.e., abnormally) to stably fix the toner image, the examination unit 260 generates the power supply interruption signal. Adequately (or sufficiently or normally) supplying the roller power indicates that the roller power is supplied as intended (needed to stably fix the toner image) by the power supply unit 210. Then, the power supply unit 210 operates in response to the first, second, or third warm-up indication signal, or the fixing indication signal because no power supply interruption signal has been generated in this case, for example. The power supply interruption signal is a signal which allows the power supply unit 210 to interrupt (or to prevent) supplying roller power to the heating resistor.

The aforementioned power supply unit 210, the temperature measuring unit 220, the first comparing unit 240, and the second comparing unit 250 may operate under the control of the heating control unit (not illustrated), and the toner fixing unit 230, and the examination unit 260 may operate under the control of the non-heating control unit (not illustrated).

Figures 3A, 3B:
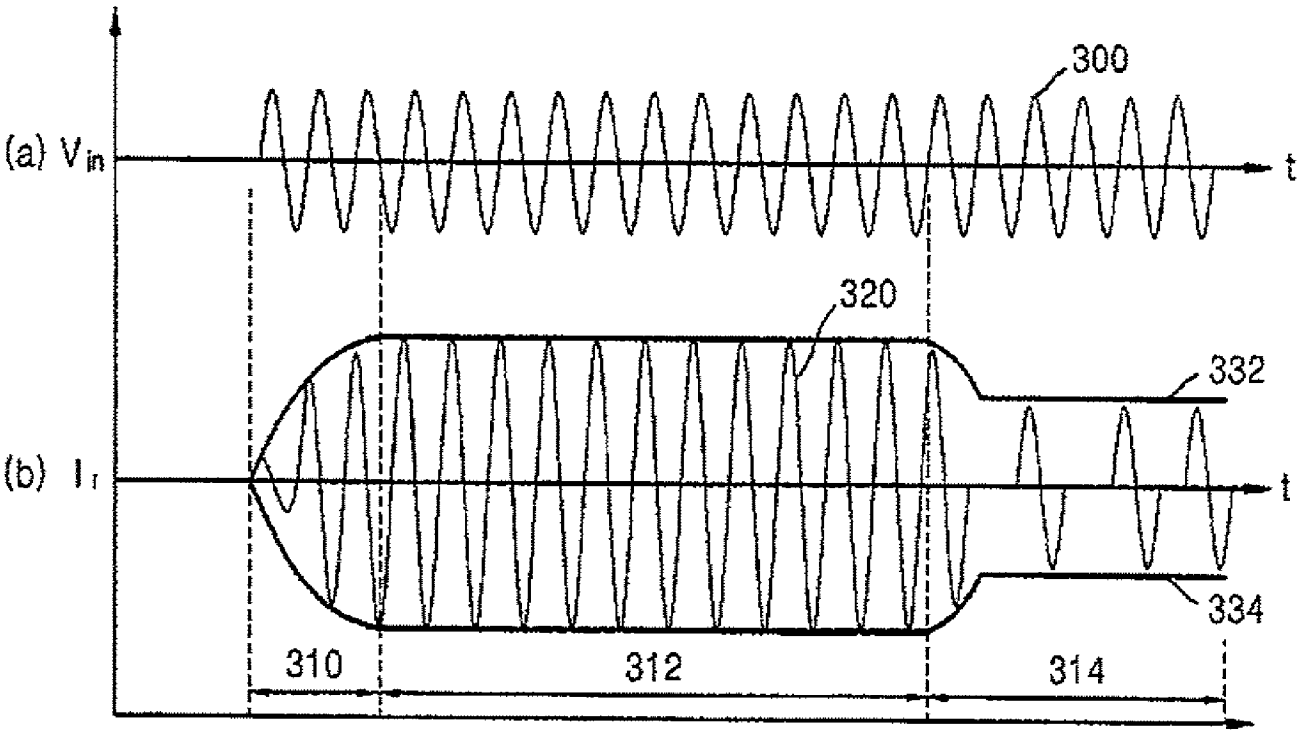
FIGS. 3A and 3B are waveform diagrams illustrating a power control principle of heating a heating roller according to an embodiment of the present general inventive concept.

FIGS. 3A and 3B are waveform diagrams illustrating a power control principle to heat a heating roller according to an embodiment of the present general inventive concept. Referring to FIGS. 3A and 3B, some or all of the source voltage (Vin) 300 in the form of a sinusoidal wave is generated by a source voltage generating unit (not illustrated) and is applied to a heating resistor having a variable resistance which increases in proportion to its temperature. Thus, as the temperature of the heating resistor increases, its resistance also increases proportionately, and vice versa. Accordingly, a roller current (Ir) 320 flows through the heating roller. For this, the power supply unit 210 accepts some or all of the source voltage 300 from the source voltage generating unit (not illustrated), and transfers the source voltage 300 to the heating resistor as the roller voltage, as illustrated in FIGS. 3A and 3B.

Here, the source voltage 300, the roller voltage, and the roller current 320 have a waveform in the form of alternating current. As a result, as described above, the source power and the roller power also have a waveform in the form of alternating current. Specifically, between envelopes 332 and 334 of the roller current 320, envelopes of the source power and the roller power have the same positive shape of envelope 332.

The waveform of the roller current 320 flowing through the heating resistor can be divided into three sections which are a flicker characteristic improving section 310, a maximum power supplying section 312, and a fixing section 314.

In the flicker characteristic improving section 310, the power supply unit 210 operates in response to the first or second warm-up indication signal and the switching signal. However, if the switching signal generator 212, the first synchronizing signal generator 214, the second synchronizing signal generator 216, and the attenuation signal generator 218 are not disposed in the power control apparatus according to an embodiment of the present general inventive concept, in the flicker characteristic improving section 310, the power supply unit 210 operates in response to the first or second warm-up indication signal.

More specifically, in the flicker characteristic improving section 310, the power supply unit 210 supplies the source power to the heating resistor as the roller power while gradually increasing the maximum level of the source power up to the maximum supply level. Until the maximum level of the source power reaches the maximum supply level, the roller voltage applied to the heating resistor is a portion of the source voltage 300.

During the flicker characteristic improving section 310, the resistance of the heating resistor reaches a critical resistance. The critical resistance is a resistance of the heating resistor at a time when the resistance does not change although the roller power is continuously provided through the heating resistor. The critical resistance may be calculated with the maximum supply level set to the maximal rated level.

In the maximum power supplying section 312, the power supply unit 210 operates in response to the third warm-up indication signal. Specifically, in the maximum power supplying section 312, the power supply unit 210 supplies the source power (the maximum level of which is equal to the maximum supply level) to the heating resistor (as the roller power). The source voltage 300 is fully applied to the heating resistor as the roller voltage in the maximum power supplying section 312, as illustrated in FIGS. 3A and 3B.

As described above, the maximum supply level is the upper limit of the roller power which can be supplied to the heating resistor. The maximum supply level may exceed the maximal rated level. In other words, the maximum supply level may exceed the maximal rated level, may be at the maximal rated level, or may be less then the maximal rated level. According to an embodiment of the present general inventive concept, a rising curve of the surface temperature of the heating roller (being supplied with roller power at the maximum supply level) approximates, or exactly matches the rising curve of the surface temperature of the heating roller being supplied with roller power when the maximum supply level equals the maximal rated level.

For such matching of the rising curves, the second comparing unit 250 compares the maximum supply level with the maximal rated level, and calculates a fourth predetermined time K2 which is inversely proportional to how much (i.e., an excess value of) the maximum supply level exceeds the maximal rated level, when the maximum supply level is greater than the maximal rated level. In this case, the power supply unit 210 supplies source power (at the maximum supply level) to the heating resistor during the fourth predetermined time K2 which occurs during every period designated as the third predetermined time K1, as illustrated in FIGS. 9A and 9B.

In the fixing section 314, the power supply unit 210 and the toner fixing unit 230 operate in response to the fixing indication signal. Specifically, in the fixing section 314, the power supply unit 210 supplies the source power (the maximum level of which is now equal to the thermostat level) to the heating resistor (as the roller power), and the toner fixing unit 230 fixes the toner image onto the printing medium by using the heating roller. The roller voltage applied to the heating resistor in the fixing section 314 is a portion of the source voltage 300, as illustrated in FIGS. 3A and 3B.

The surface temperature of the heating roller above has a first specific similarity with respect to the fixing target temperature. For example, the surface temperature may be in the range of 95%~105% of the fixing target temperature. Here, the surface temperature is between the minimum fixable temperature and the maximum fixable temperature.

If the print data is provided to fit on a small number of sheets of paper, for example, two sheets of paper, the surface temperature may not fall below the minimum fixable temperature even though the roller power supplied to the heating roller is interrupted (no longer supplied or not supplied) before all the print data is fixed. In this case, the power supply unit 210 may not supply the source power (the maximum level of which is equal to the thermostat level) to the heating resistor (as the roller power), and yet the toner fixing unit 230 may fix the toner image in a stable manner in the fixing section 314.

On the other hand, if the print data is provided to fit on a large number of sheets of paper, for example, ten sheets of paper, the surface temperature may fall below the minimum fixable temperature if the roller power supplied to the heating roller is interrupted (no longer supplied or not supplied) before all the print data is fixed. In this case, the power supply unit 210 has to supply the source power (the maximum level of which is equal to the thermostat level) to the heating resistor as the roller power in the fixing section 314.

The roller power may be supplied to each of heating resistors of the heating roller used during the flicker characteristic improving section 310 and during the maximum power supplying section 312. Whereas, the roller power may be supplied only to selected heating resistors among all the heating resistors of the heating roller during the fixing section 314.

Here, the heating resistors initially selected to receive source power may be selected by the non-heating control unit (not illustrated), and the heating control unit may then periodically or (non-periodically) change the selected heating resistors that receive source power, for example. In the fixing section 314, a time required for the roller current 320 to flow through the initially selected heating resistors includes the time required for the heating resistors themselves to be initially selected by the non-heating control unit (not illustrated).

If the examination unit 260 is part of the image forming apparatus according to an embodiment of the present general inventive concept, the flicker characteristic improving section 310, and the maximum power supplying section 312 are described as follows.

If the examination unit 260 responds to the first or second warm-up indication signal and the initializing completion indication signal, then the examination unit 260 examines whether the image forming apparatus is instructed to print the print data and whether the roller power is adequately supplied normally (sufficient to stably fix the print data) during the flicker characteristic improving section 310.

In this case, if it is determined that the image forming apparatus is not instructed to print the print data or that the roller power is not adequately supplied (not sufficient to stably fix the print data), then the power supply 210 instructs the heating control unit (not illustrated) not to generate the first warm-up indication signal and instructs the first comparing unit 240 not to generate the second warm-up indication signal. Accordingly, the roller power that may be supplied to the heating resistor is interrupted, and the flicker characteristic improving section 310 is also interrupted. On the other hand, if it is determined that the image forming apparatus is instructed to print the print data and that the roller power is adequately supplied normally (sufficient to stably fix the print data), then the roller power supplied to the heating resistors remains uninterrupted and the flicker characteristic improving section 310 proceeds as predetermined.

If the examination unit 260 responds to the third warm-up indication signal and the initializing completion indication signal, then the examination unit 260 examines whether the image forming apparatus is instructed to print the print data and whether the roller power is supplied normally during the maximum power supplying section 312.

In this case, if the examination unit 260 determines that the image forming apparatus is not instructed to print the print data or that the roller power is inadequately supplied, then the power supply 210 instructs the first comparing unit 240 or the second comparing unit 250 not to generate (or interrupt or stop generating) the third warm-up indication signal. Accordingly, the roller power that may be supplied to the heating resistor is interrupted, and the maximum power supplying section 312 is also interrupted. On the other hand, if the examination unit 260 determines that the image forming apparatus is instructed to print the print data and that the roller power is adequately supplied normally, then the roller power supplied to the heating resistors remains uninterrupted and the maximum power supplying section 312 proceeds as predetermined.

Figure 4:
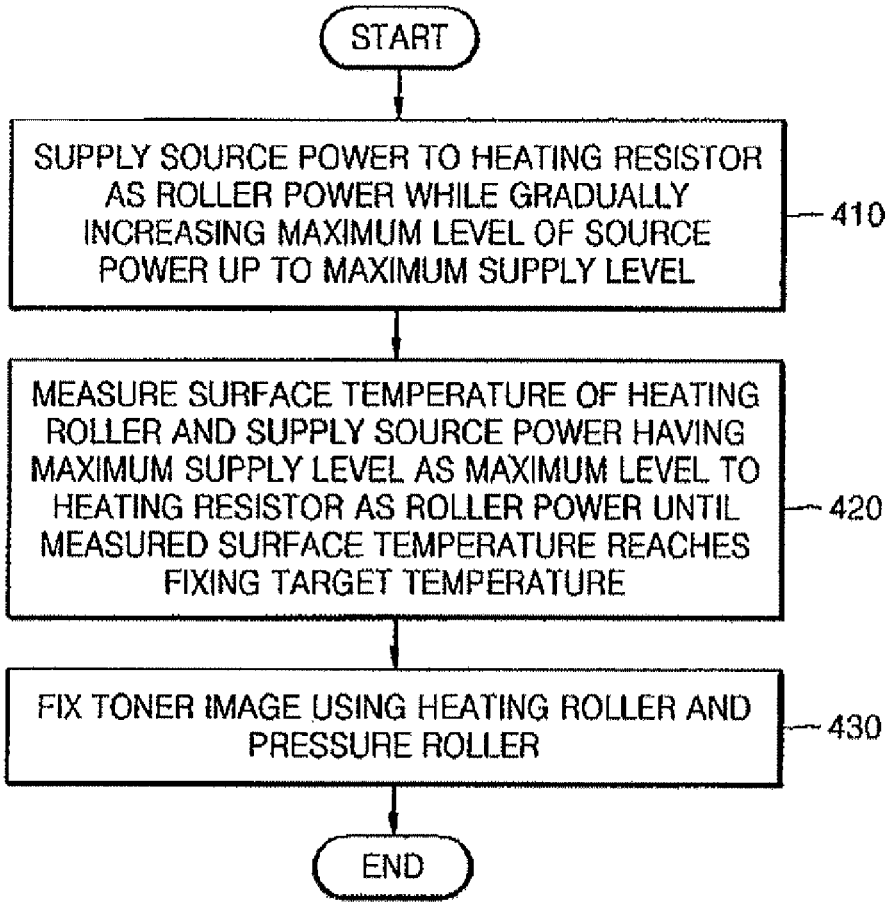
FIG. 4 is a flowchart illustrating a power control method of heating a heating roller according to an embodiment of the present general inventive concept.

FIG. 4 is a flowchart illustrating a power control method to heat a heating roller according to an embodiment of the present general inventive concept. The method includes operations (operations 410 to 430) which improve a flicker characteristic and allows the surface temperature of the heating roller to rapidly reach the fixing target temperature. This is achieved by supplying the roller power to the heating resistor differently in the flicker characteristic improving section 310, the maximum power supplying section 312, and the fixing section 314, with respect to one another.

The power supply unit 210 gradually increases the maximum level of the source power up to a specific maximum supply level, and supplies the source power at the (gradually increasing) maximum level to the heating resistor as the roller power (operation 410). Operation 410 may be performed right after the image forming apparatus (connected to the power supply unit) is turned on, or right after the image forming apparatus is switched from the standby mode to the print mode.

After operation 410, the temperature measuring unit 220 measures the surface temperature of the heating roller, and the power supply unit 210 supplies the source power (the maximum level of which is equal to the maximum supply level) to the heating resistor (as the roller power) until the measured surface temperature (of the heating roller) reaches a specific fixing target temperature (operation 420).

After the operation 420, the power supply unit 210 supplies the source power (the maximum level of which is equal to the thermostat level) to the heating resistor, and the toner fixing unit 230 fixes the toner image of the print data onto the printing medium by using the heating roller and the pressure roller (operation 430).

Meanwhile, while performing the operation 410 or 420, the examination unit 260 determines whether the image forming apparatus is instructed to print the print data and whether the roller power is adequately supplied normally. In this case, the operation 430 is performed, only if it is determined that the image forming apparatus is instructed to print the print data and that the roller power is adequately supplied normally. The operations 410 and 420 may be controlled by the heating control unit (not illustrated), and the operation 430 may be controlled by the non-heating control unit (not illustrated). The operations 410, 420, and 430 correspond to the flicker characteristic improving section 310, the maximum power supplying section 312, and the fixing section 314, respectively.

After operation 430, the non-heating control unit (not illustrated) determines the time elapsed when print data is no longer being received, and if it is determined that the elapsed time when print data is not being received is equal to or exceeds the standby mode determining time (operation 430 is completed), the image forming apparatus is switched to the standby mode.

In this case, the non-heating control unit (not illustrated) also determines when new or additional print data is received after the image forming apparatus is switched to (or is in) the standby mode. If it is determined that the print data (e.g., new or additional print data) is received (or is being received) after the image forming apparatus has been switched to (or is in) the standby mode, then the image forming apparatus is switched to the print mode, and the power supply unit 210 is instructed to execute operations 410 to 430, as needed.

Figure 5:
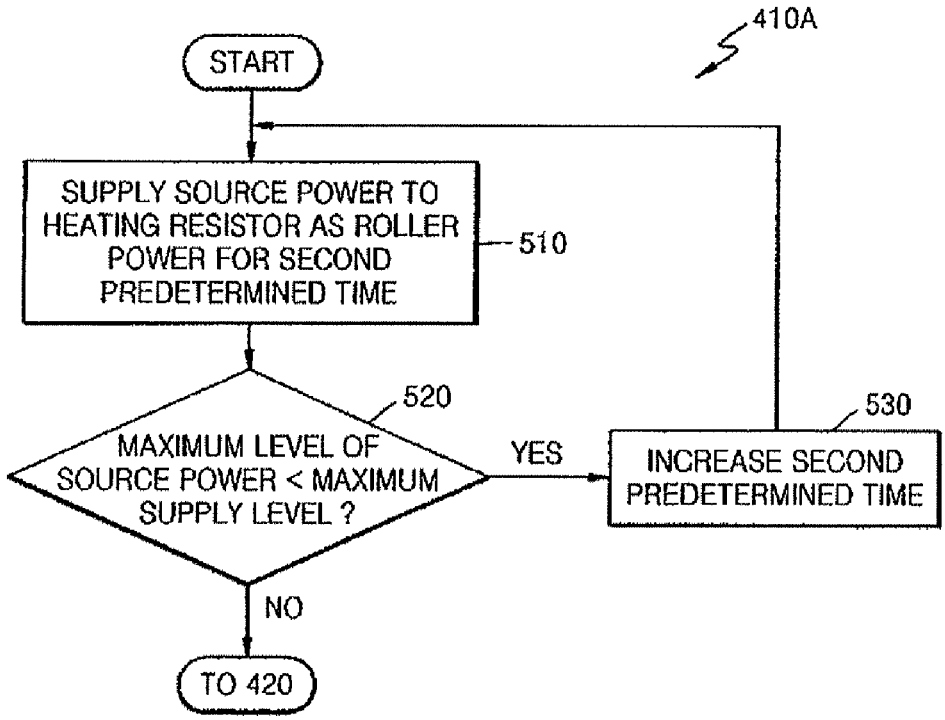
FIG. 5 is a flowchart illustrating an operation of a power control method according to an embodiment of the present general inventive concept.

FIG. 5 is a flowchart illustrating operation 410 of FIG. 4 according to an embodiment 410A of the present general inventive concept. In operations 510 to 530, the maximum level of the source power is gradually increased up to the maximum supply level, and the source power is supplied at the (gradually increased) maximum level to the heating resistor as the roller power.

The power supply unit 210 supplies the source power to the heating resistor (as the roller power having a first predetermined time interval) for a second predetermined time (operation 510). The first predetermined time is a set upper limit of the second predetermined time. The first determined time may be invariable. The second predetermined time may be variable.

After operation 510, the first comparing unit 240 determines whether the maximum level of the source power supplied in operation 510 is less than the maximum supply level (operation 520).

If it is determined that the maximum level supplied is less than the maximum supply level in operation 520, the first comparing unit 240 instructs the power supply unit 210 to increase the second predetermined time and to allow the power supply unit 210 to repeat operation 510 (operation 530).

On the other hand, if it is determined that the maximum level supplied is not less than the maximum supply level in operation 520, then operation 420 is completed.

The second predetermined time is gradually increased so that the maximum level of the source power supplied approaches and eventually equals (or approximately equals) the maximum supply level. Accordingly, the degree or occurrence of the flicker characteristic is reduced (or becomes less pronounced), which may occur (for example) when the roller power is rapidly (and/or excessively) supplied to the heating resistor at a point where the image forming apparatus is turned on or where the image forming apparatus is switched from the standby mode to the print mode.

FIGS. 6A, 6B, 6C, 6D and 6E include waveforms corresponding to certain operations of the flowchart illustrated in FIG. 5, when the switching signal generator 212 through the attenuation signal generator 218 are part of the power control apparatus according to one or more embodiments of the present general inventive concept.

Specifically, FIG. 6A illustrates the source voltage (Vin) 300 illustrated in FIG. 3A. FIG. 6B illustrates a first synchronizing signal (S1) 610. FIG. 6C illustrates a second synchronizing signal (S2) 620 and an attenuation signal (A1) 630.

In addition, FIG. 6D illustrates the switching signal (S3) 640. FIG. 6E illustrates the roller voltage (Vin') 650. As illustrated in FIG. 6E, the roller voltage (Vin') 650 in the flicker characteristic improving section 310 is the source voltage (Vin) 300 corresponding to the non-zero signal section Q2 of the switching signal (S3) 640.

As shown in FIG. 6D, Q1 is the first predetermined time, and Q2 is the second predetermined time. That is, Q2 is the time width of the non-zero signal section of the switching signal S3. As illustrated in FIG. 6D, the second predetermined time Q2 gradually increases up to (and/or including) Q1.

Figure 7:
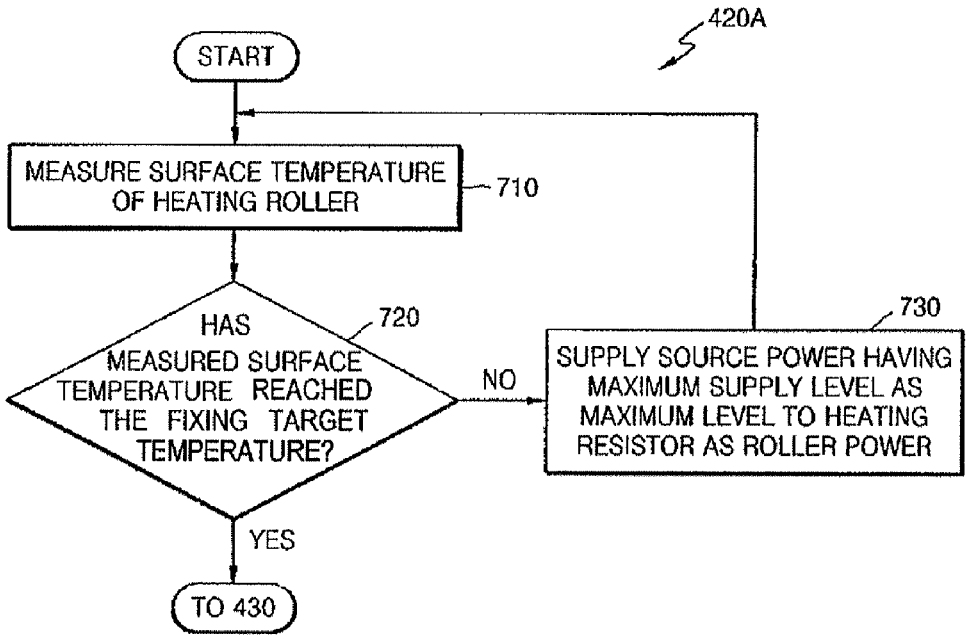
FIG. 7 is a flowchart illustrating an operation of a power control method according to an embodiment of the present general inventive concept.

FIG. 7 is a flowchart illustrating operation 420 of FIG. 4 according to an embodiment 420A of the present general inventive concept. In operations 710 to 730, the surface temperature of the heating roller is measured, and the source power (the maximum level of which is equal to the maximum supply level) is supplied at the maximum level to the heating resistor (as the roller power) until the measured surface temperature reaches the fixing target temperature.

The temperature measuring unit 220 measures the surface temperature of the heating roller (operation 710). The second comparing unit 250 determines whether the surface temperature measured in operation 710 is equal to the fixing target temperature (operation 720). In other words, in operation 720, it is determined whether the measured surface temperature has reached the fixing target temperature.

If it is determined that the surface temperature measured in operation 710 is not equal to the fixing target temperature (operation 720), the power supply unit 210 continues to supply the source power (the maximum level of which is equal to the maximum supply level) at the maximum level to the heating resistor as the roller power (operation 730).

On the other hand, if it is determined that the surface temperature measured in operation 710 is equal to the fixing target temperature (operation 720), operation 420 is completed.

Figure 8:
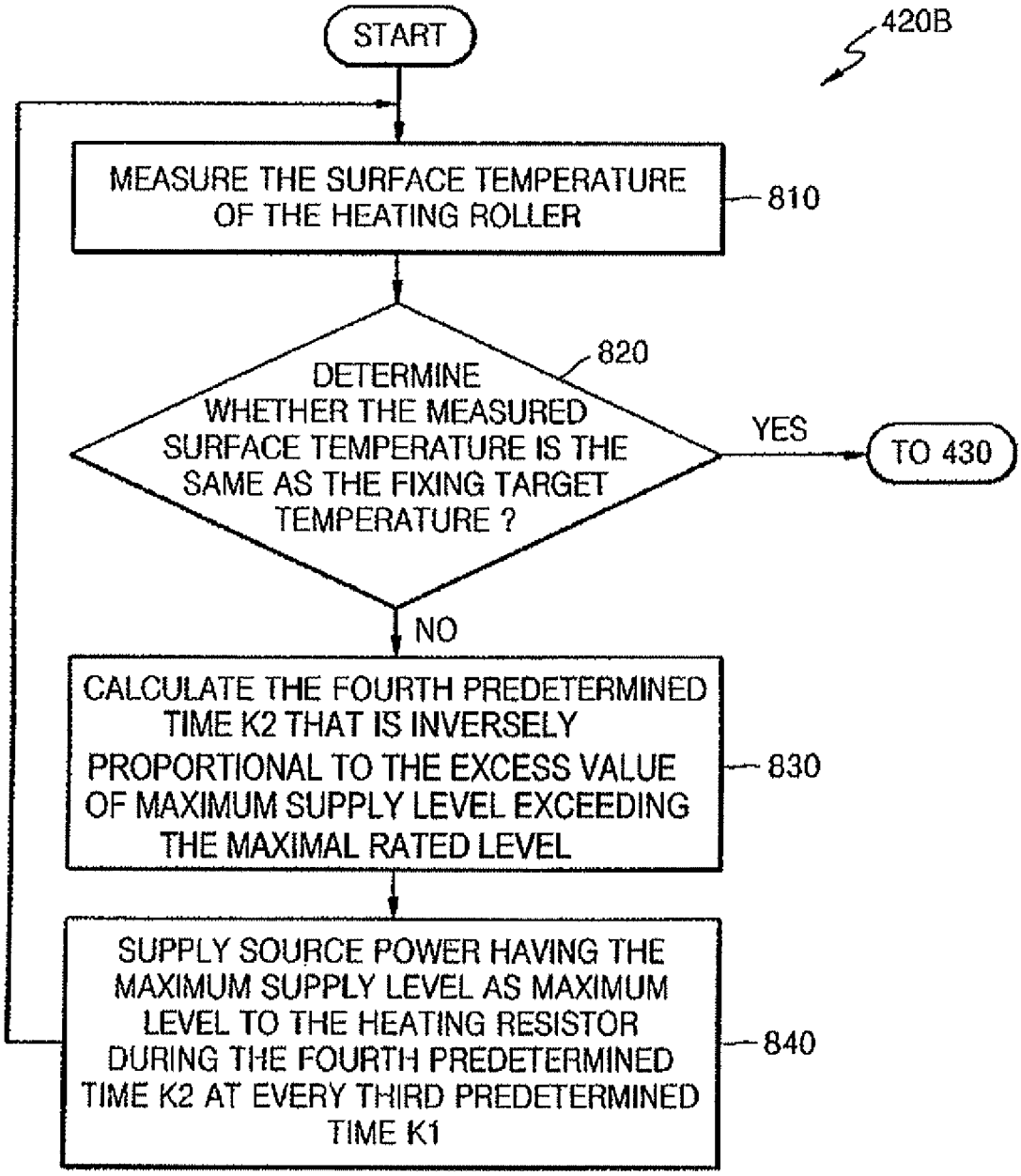
FIG. 8 is a flowchart illustrating an operation of a power control method according to an embodiment of the present general inventive concept.

FIG. 8 is a flowchart of operation 420 illustrated in FIG. 4 according to another embodiment 420B of the present general inventive concept. The operation 420 includes sub-operations 810, 820, 830, and 840 in which the source power (having the maximum supply level as an upper limit) is supplied to the heating resistor at the maximum supply level during a period corresponding to how much (i.e., an excess value of) the maximum supply level that exceeds the maximal rated level until the surface temperature of the heating roller reaches the fixing target temperature.

First, the temperature measuring unit 220 measures the surface temperature of the heating roller (operation 810).Second, the second comparing unit 250 determines whether the measured surface temperature in the operation 810 is the same as the fixing target temperature (operation 820).

If the measured surface temperature is not the same as the fixing target temperature in operation 820, the second comparing unit 250 calculates a fourth predetermined time K2 which is inversely proportional to an excess value of the maximum supply level that exceeds the maximal rated level (operation 830). In other words, the calculated fourth predetermined time K2 is inversely proportional to the amount of the maximum supply level that exceeds the maximal rated level. Thus, for example, if the maximum supply level exceeds the maximal rated level by say 10%, then the next corresponding calculated fourth predetermined time K2 is correspondingly shorter (or smaller) as the maximum supply level that exceeds the maximal rated level is increased over 10%, e.g., by more than 11%, by more than 12%, by more than 13%, by more than 20%, etc.

After the operation 830, the power supply unit 210 supplies source power (having the maximum supply level as a maximum level) to the heating resistor during the fourth predetermined time K2 during every period designated as the third predetermined time K1 (operation 840), as further illustrated in FIG. 9B.

On the contrary, if the measured surface temperature is the same as the fixing target temperature in operation 820 then operation 420 is completed and the next operation is operation 430 illustrated in FIG. 4.

FIGS. 9A and 9B are diagrams of waveforms corresponding to operation 840 illustrated in FIG. 8. As illustrated in FIGS. 9A and 9B, a maximum level (equal to the maximum supply level) of the roller power is being supplied to the heating resistor in the maximum power supplying section 312. Here, the maximum supply level Mp, may exceed the maximal rated level Ms by (Mp-Ms). So, as noted above, K2 decreases as (Mp−Ms) increases.

As illustrated in FIG. 9A, if the roller power is supplied so that Mp>Ms, the surface temperature of the heating roller has a high probability of overshooting the fixing target temperature. If the roller power is supplied so that Mp<Ms, the surface temperature of the heating roller has a high probability of undershooting the fixing target temperature. Excessive overshooting and undershooting cause problems such as decrease in fixedness and shortening of a life cycle of the heating resistor. So the overshooting and undershooting problems should be prevented from occurring or should occur less frequently to provide improved fixedness and/or improved life cycle of the heating resistor.

To minimize occurrences of the overshooting and undershooting, according to an embodiment of the present general inventive concept, the source power is supplied at the maximum supply level to the heating resistor (as the roller power) during the fourth predetermined time K2 of every third predetermined time K1, as illustrated in FIG. 9B.

FIG. 10 is a flowchart illustrating operation 430 of FIG. 4 according to an embodiment 430A of the present general inventive concept. In operations 1010 to 1030, the source power (the maximum level of which is equal to the thermostat level) is supplied to the heating resistor (as the roller power) to fix the toner image.

The non-heating control unit (not illustrated) selects one or more heating resistors among a plurality of heating resistors (e.g., less than all or all) included in the heating roller (operation 1010).

After operation 1010, the power supply unit 210 supplies the source power (the maximum level of which is equal to the thermostat level) to the heating resistor selected in operation 1010 as the roller power (operation 1020).

After operation 1020, the toner fixing unit 230 fixes the toner image onto the printing medium by using the heating roller and the pressure roller (operation 1030).

Figure 11:
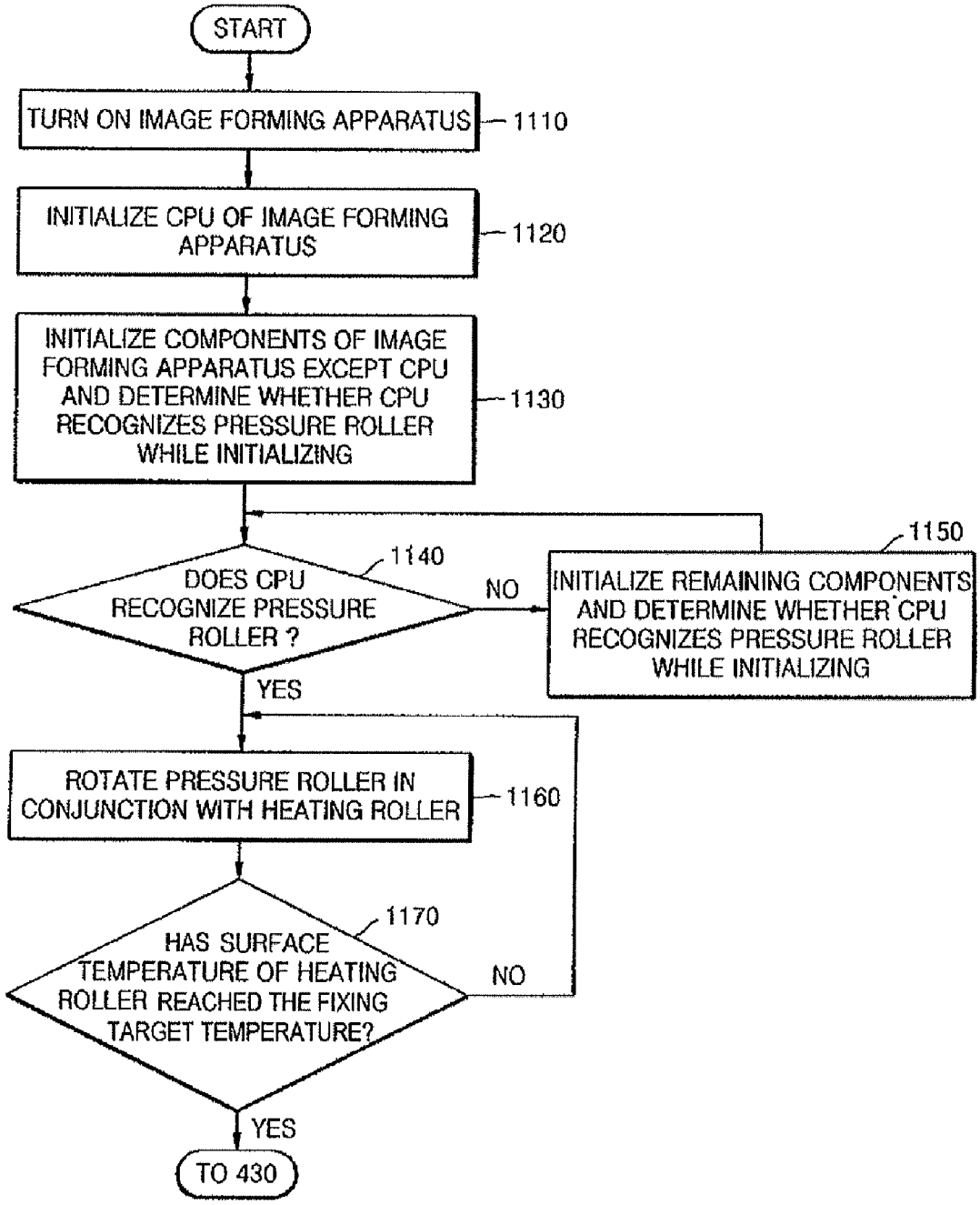
FIG. 11 is a flowchart illustrating a process of heating a surface of a pressure roller up to a fixing target temperature, according to an embodiment of the present general inventive concept.

FIG. 11 is a detailed flowchart illustrating a process of heating the surface of a pressure roller up to a fixing target temperature before operation 430 of FIG. 4 is executed, according to an embodiment of the present general inventive concept. Referring to FIG. 11, the process of heating the surface of the pressure roller includes operations 1110 through 1170 to heat the surface of the pressure roller while operation 420 of FIG. 4 is being completed right after the non-heating controller of the image forming apparatus recognizes the pressure roller.

Figure 12:
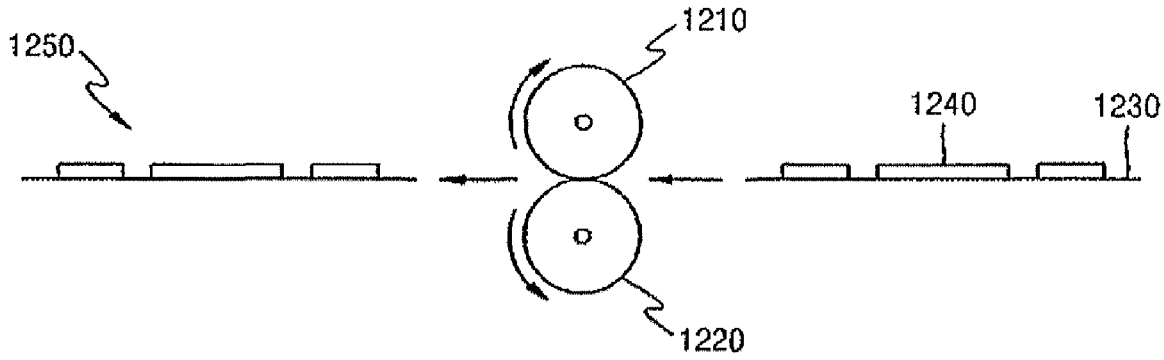
FIG. 12 is a reference diagram illustrating operations of the process of FIG. 11.

In addition, FIG. 12 is a reference diagram corresponding to certain operations of the process of FIG. 11. Further, FIGS. 13A and 13B are plots of surface temperature versus time corresponding to or used to explain certain operations of the process of FIG. 11. FIG. 13A illustrates a timing graph 1310 of the surface temperature of the heating roller according to the conventional power control principle. FIG. 13B illustrates a timing graph 1320 of the surface temperature of the heating roller according to the power control principle of an embodiment of the present general inventive concept. The process of FIG. 11 will now be described in detail with reference to FIGS. 12, 13A and 13B.

Referring to FIG. 12, FIGS. 13A and 13B, when the surface temperature of a heating roller 1210 is at a fixing target temperature $ST_t$ and the surface temperature of a pressure roller 1220 is below the minimum fixable temperature, then if a printing medium 1230 is fed between these rollers to execute a fixing job, the heating roller 1210 loses heat to the pressure roller 1220, and thereby the surface temperature of the heating roller 1210 may drop below the minimum fixable temperature. In this case, a toner image 1240 cannot be stably fixed onto the printing medium 1230, and thereby print quality of a printed result 1250 is degraded.

To stably fix the toner image 1240 onto the printing medium 1230, both the surface temperature of the heating roller 1210 and the surface temperature of the pressure roller 1220 should be the same as the fixing target temperature $ST_t$ or approximately at $ST_t$ sufficient to accomplish stable fixing. That is, before operation 430 of FIG. 4 is executed, both the surface temperature of the heating roller 1210 and the surface temperature of the pressure roller 1220 must (or should) reach the fixing target temperature $ST_t$.

To increase the surface temperature of the pressure roller 1220, the pressure roller 1220 must accept the heat from the heating roller 1210 while operating in conjunction with the heating roller 1210 because the pressure roller 1220 does not have any of its own heating resistors unlike the heating roller 1210, for example.

Considering this exemplary configuration, the variation of the surface temperature of the heating roller 1210 in the flicker characteristic improving section 310 and the maximum power supplying section 312 will now be described.

According to the conventional power control principle, both the heating related job and the non-heating related job are controlled by the same controller (not illustrated). In this case, when the image forming apparatus is turned on or the mode of the image forming apparatus is switched from the stand-by mode to the print mode, i.e., when t=0 (t denotes time), the controller (not illustrated) of the conventional image forming apparatus is initialized for a duration T1(t=0~t1). The controller may be a CPU of the image forming apparatus.

The other components of the image forming apparatus except the controller (not illustrated) are initialized for a duration T2(t=t1~t3) after the time (t=t1) when the initialization of the controller is completed. That is, the conventional controller (not illustrated) recognizes the pressure roller 1220 and the heating roller 1210 at a certain moment along or after duration T2.

From the moment when the conventional controller (not illustrated) recognizes the heating roller 1210, power is supplied to the heating resistor. Thus for example, if the conventional controller recognizes the heating roller 1210 at the time t=t2, the surface temperature of the heating roller 1210 begins to increase at the earliest at the time t=t2, as illustrated in FIG. 13A.

The surface temperature of the heating roller 1210 reaches a fixing ready temperature $ST_r$, e.g., 160° C., at the time t=t4 when a duration T4 has lapsed from the time t=t3. Then, the pressure roller 1220 operates in conjunction with the heating roller 1210 from the time t=t4 . The pressure roller 1220 (which can operate in conjunction with the heating roller 1210) is recognized at t=t3. The surface temperature of the heating roller 1210 increases from the time t=t2 until t=t4 with a slope at a duration T4. However, the surface temperature of the heating roller 1210 cannot increase as quickly when the pressure roller 1220 operates in conjunction with heating roller 1210 because the pressure roller 1220 absorbs heat from the heating roller 1210. Thus, the slope in duration T5 (t5−t4) is less than the slope in duration T4. The pressure roller 1220 operates in conjunction with the heating roller 1210 from the time t=t4.

As noted, the surface temperature of the pressure roller 1220 increases from the time t=t4, and accordingly, the surface temperature of the heating roller 1210 increases less quickly in the duration T5 as compared to that in duration T4. In addition, both the surface temperature of the heating roller 1210 and the surface temperature of the pressure roller 1220 reach the fixing target temperature $ST_t$ at the time t=t5 at the end of duration T5.

Thus, according to the conventional power control principle, if a print command is received right after the image forming apparatus is turned on (t=0+) or when the image forming apparatus is switched into the print mode from the stand-by mode (t=0+), the FPOT cannot be below T1+T2+T4.

According to an embodiment of the present general inventive concept, right after the image forming apparatus is turned on (t=0+) or right after the mode of the image forming apparatus is switched from the stand-by mode to the print mode (t=0+), the heating controller (not illustrated) immediately recognizes the heating roller 1210 and immediately instructs the power supply unit 210 to begin to supply source power to the heating resistor. Thus, according to one or more embodiments of the present general inventive concept, the duration corresponding to T3 described above is eliminated from the FPOT. Thus, FPOT can be reduced by the duration T3 (from that of a conventional power control principle) when using an embodiment of the present general inventive concept.

Referring to FIG. 13B, the pressure roller 1220 operates in conjunction with the heating roller 1210 as soon as the pressure roller 1220 is recognized by the non-heating controller (not illustrated) (t=t6+) regardless of whether the surface temperature of the heating roller 1210 reaches the fixing ready temperature $ST_r$. In this case, the surface temperature of the pressure roller 1220 increases from the time t=t6, and thereby, the surface temperature of the heating roller 1210 increases less quickly in a duration t=t6+~t7 compared to a duration t=0~t6−. The time t6 corresponds to the time t2 and may be included in the flicker characteristic improving section 310 and/or the maximum power supplying section 312. Both the surface temperature of the heating roller 1210 and the surface temperature of the pressure roller 1220 reach the fixing target temperature $ST_t$ at the time t=t7.

Thus, according to one or more embodiments of the present general inventive concept, operations 1110 through 1170 are performed before operation 430 of FIG. 4 is executed as further described below.

In operation 1110, the image forming apparatus is turned on, or the mode of the image forming apparatus is switched from the stand-by mode to the print mode (t=0). In operation 1120, the non-heating controller is initialized.

In operations 1130 through 1160, the pressure roller 1220 operates in conjunction with the heating roller 1210 as soon as the pressure roller 1220 is recognized by the non-heating controller.

That is, in operation 1130, the non-heating controller recognizes at least one (one or more) of the components (of the image forming apparatus). In operation 1140, the non-heating controller determines whether the pressure roller 1220 has been recognized by the CPU.

If it is determined (in operation 1140) that the pressure roller 1220 has not been recognized by the CPU, then operation 1150 is executed, where the non-heating controller recognizes at least one of any other remaining unrecognized components, and proceeds back to the operation 1140.

Once the pressure roller 1220 has been recognized by the CPU (in operation 1140), the toner fixing unit 230 operates the pressure roller 1220 in conjunction with the heating roller 1210 in operation 1160, and the second comparing unit 250 determines in operation 1170 whether the surface temperature of the heating roller 1210 has reached the fixing target temperature $ST_t$.

If (in operation 1170) it is determined that the surface temperature of the heating roller 1210 has not reached the fixing target temperature $ST_t$, then the process is directed back to operation 1160 which is repeated followed by operation 1170 according to the flowchart of FIG. 11, for example. If (in operation 1170) it is determined that the surface temperature of the heating roller 1210 has reached the fixing target temperature $ST_t$, then operation 420 of FIG. 4 is completed. Then the process proceeds to operation 430 of FIG. 4.

Figure 14:
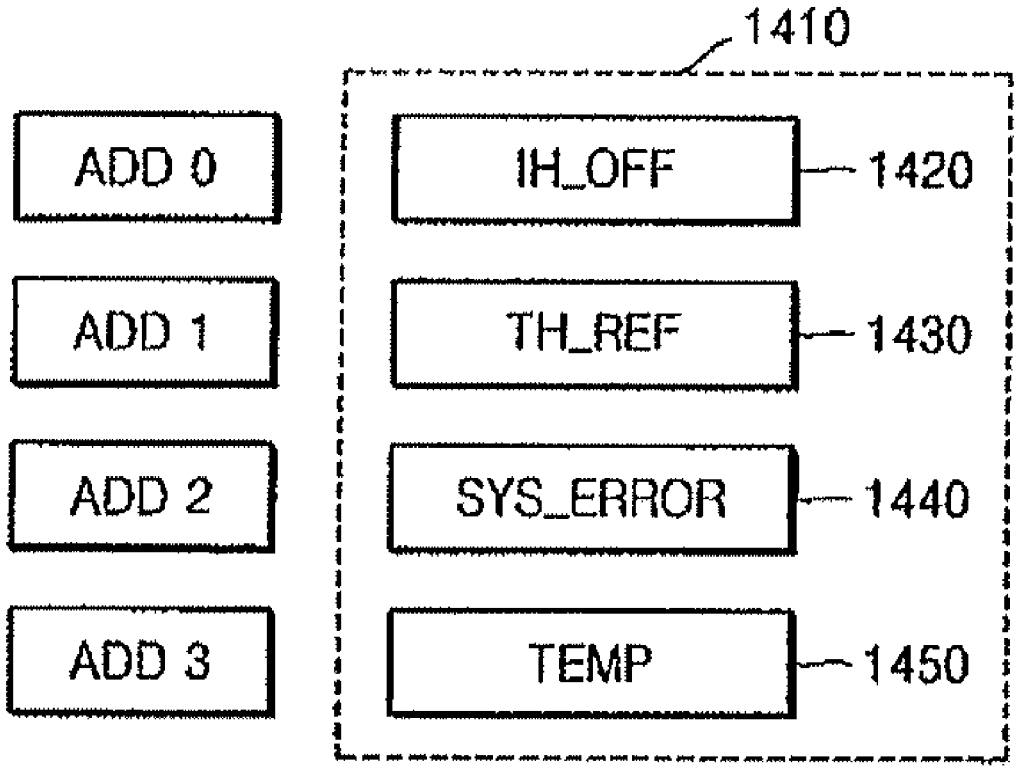
FIG. 14 illustrates control data stored in an image forming apparatus according to an embodiment of the present general inventive concept.

FIG. 14 illustrates control data that may be stored in a heating control unit (not illustrated) and a non-heating control unit (not illustrated) according to one or more embodiments of the present general inventive concept. The heating control unit (not illustrated) and the non-heating control unit (not illustrated) may include predetermined storage units therein, respectively. The storage unit may be embodied as a RAM. For convenience of description, the storage unit included in the heating control unit (not illustrated) is referred to as a first storage unit. The storage unit included in the non-heating control unit (not illustrated) is referred to as a second storage unit. The heating control unit (not illustrated) can receive/transmit control data 1410 to/from the non-heating control unit (not illustrated).

As illustrated in FIG. 14, the control data 1410 may include power supply interruption information 1420 to indicate that the supply of the roller power is interrupted (IH_OFF), fixing target temperature information 1430 to indicate the fixing target temperature (TH_REF), error indicating information 1440 to indicate that the roller power is inadequately (or insufficiently) supplied (i.e., abnormally) (SYS_ERROR) necessary to stably fix the toner image, and measured surface temperature information 1450 to indicate the measured surface temperature of the heating roller (TEMP). As illustrated in FIG. 14, zeroth, first, second, and third addresses ADD 0, ADD 1, ADD 2, and ADD 3 indicate addresses for storing the power supply interruption information 1420, the fixing target temperature information 1430, the error indicating information 1440, and the measured surface temperature information 1450, respectively.

As described above, the operations of the power supply unit 210, the temperature measuring unit 220, the first comparing unit 240, and the second comparing unit 250 are controlled by the heating control unit (not illustrated), then the control data 1410 stored in the first storage unit (not illustrated) is updated according to the operating result whenever each of the aforementioned elements 210, 220, 240 and 250 perform an appropriate operation. In this case, the heating control unit (not illustrated) can transmit the updated control data 1410 to the non-heating control unit (not illustrated), and the non-heating control unit (not illustrated) can update the control data 1410 stored in the second storage unit (not illustrated).

Similarly, if the operations of the toner fixing unit 230 and the examination unit 260 are controlled by the heating control unit (not illustrated), then the control data 1410 stored in the first storage unit (not illustrated) is updated according to the operating result whenever each of the aforementioned elements 230 and 260 perform an appropriate operation. In that case, the non-heating control unit (not illustrated) can transmit the updated control data 1410 to the non-heating control unit (not illustrated), and the non-heating control unit (not illustrated) can update the control data 1410 stored in the second storage unit (not illustrate).

The aforementioned power supply interruption signal may be defined as a signal including the power supply interruption information 1420 and the error indicating information 1440.

Accordingly, in a power control method and apparatus to heat a heating roller of the present general inventive concept, when the image forming apparatus is turned on, a heating roller can be heated before the rest of the image forming apparatus is fully initialized, power can be supplied to the heating roller in such a way that the power is gradually increased at an early stage and a maximum power is supplied after a specific time elapses. Thus, the flicker characteristic can be improved, and a surface temperature of the heating roller can rapidly reach a fixing target temperature. In addition, according to the present general inventive concept, the surface temperature of the heating roller can reach the fixing target temperature quickly without overshooting or undershooting even when the maximum supply level exceeds the maximal rated level.

One or more embodiments of the general inventive concept can also be provided as computer readable codes as a program on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A power control apparatus to heat a heating roller, provided to fix a toner image of print data in an image forming apparatus, the heating roller having a heating resistor to receive roller power, the power control apparatus comprising:

a power supply unit to gradually increase a maximum level of a source power supplied from an external source up to a specific maximum supply level in response to a first or a second warm-up indication signal, to output the source power at the maximum level to the heating resistor as the roller power in response to the first or second warm-up indication signal, to output the source power at the maximum supply level to the heating resistor as the roller power in response to a third warm-up indication signal, and to output the source power at the maximum level adjusted not to exceed a thermostat level to the heating resistor as the roller power in response to a fixing indication signal;

a temperature measuring unit to measure a surface temperature of the heating roller in response to the third warm-up indication signal and to output the measured surface temperature;

a toner fixing unit to fix the toner image of print data onto a fed printing medium by using the heating roller in response to the fixing indication signal;

a first comparing unit to compare the increased maximum level with the maximum supply level, and to generate the second or third warm-up indication signal according to a first comparison result; and a second comparing unit to compare the measured surface temperature with a specific fixing target temperature, and to generate the third warm-up indication signal or the fixing indication signal according to a second comparison result.

2. The power control apparatus of claim 1, wherein the first warm-up indication signal is generated right after the image forming apparatus is turned on, or right after the image forming apparatus is switched from a standby mode to a print mode.

3. The power control apparatus of claim 2, wherein the image forming apparatus comprises a unit to control operations related to heating including operations of the power supply unit and another unit to control operations not related to heating including operations of the toner fixing unit, and the unit and the another unit are separately provided in the image forming apparatus.

4. The power control apparatus of claim 1, wherein the power supply unit outputs the source power to the heating resistor as the roller power during a second predetermined time every first predetermined time, in response to the first or second warm-up indication signal, and wherein the second predetermined time is increased up to the first predetermined time as the maximum level of the source power approaches the maximum supply level.

5. The power control apparatus of claim 1, wherein the maximum supply level is an upper limit of the roller power supplied to the heating resistor.

6. The power control apparatus of claim 1, wherein the fixing indication signal is generated according to the second comparison result obtained by the second comparing unit, and is generated while the toner fixing unit operates.

7. The power control apparatus of claim 1, wherein the heating resistor has a variable resistance proportional to a temperature of the heating resistor which is less than or equal to a threshold temperature.

8. The power control apparatus of claim 1, wherein the power supply unit outputs the source power to the heating resistor as the roller power in response to a switching signal and one of the first and second warm-up indication signals while gradually increasing the maximum level of the source power, and wherein the switching signal is generated in response to the first or second warm-up indication signal.

9. The power control apparatus of claim 1, further comprising:

a first synchronizing signal generator to generate a first synchronizing signal having a rectangular waveform synchronized with the source power in response to the first or second warm-up indication signal;

a second synchronizing signal generator to integrate the first synchronizing signal and to output an integration result as a second synchronizing signal;

an attenuation signal generator to generate an attenuation signal to attenuate the second synchronizing signal at a predetermined slope in response to the first or second warm-up indication signal; and a switching signal generator to generate a switching signal having a non-zero rectangular waveform signal section when the attenuation signal is equal to or less than the second synchronizing signal, wherein the power supply outputs the source power to the heating resistors as the roller power at a non-zero signal section of the switching signal in response to the first or second warm-up indication signal, and wherein the attenuation signal reduces to a zero signal before the third indication signal is generated.

10. The power control apparatus of claim 1, wherein the image forming apparatus includes the heating roller and a pressure roller, the pressure roller to operate in conjunction with the heating roller as part of the toner fixing unit in response to a fourth warm-up indication signal, wherein the toner image is fixed onto the printing medium by using the heating roller and the pressure roller of the toner fixing unit to operate in response to the fixing indication signal, and wherein the fourth warm-up indication signal is generated right after the image forming apparatus recognizes the pressure roller.

11. The power control apparatus of claim 1, wherein the second comparing unit is also provided to compare the maximum supply level with a specific maximal rated level, and to generate the third warm-up indication signal intermittently according to the comparison result.

12. The power control apparatus of claim 11, wherein a rate of increase in the surface temperature of the heating roller is greater when the heating roller is not in contact with a pressure roller.

13. The power control apparatus of claim 11, wherein the maximal rated level is an upper limit of rated power that can be supplied to the heating resistor.

14. The power control apparatus of claim 1, further comprising:

an examination unit to examine whether the image forming apparatus is instructed to print the print data and to examine whether the supplied roller power is sufficient to fix the print data, and to generate a power supply interruption signal in response to the examination result, wherein the power supply unit outputs no power to the heating resistor as the roller power in response to the power supply interruption signal.

15. An image forming apparatus having a heating roller provided to fix a toner image of print data, the heating roller having a heating resistor to receive roller power, the image forming apparatus comprising:

a power supply unit to gradually increase a maximum level of a source power supplied from an external source up to a specific maximum supply level in response to a first or a second warm-up indication signal, to output the source power at the maximum level to the heating resistor as the roller power in response to the first or second warm-up indication signal, to output the source power at the maximum supply level to the heating resistor as the roller power in response to a third warm-up indication signal, and to output the source power at the maximum level adjusted not to exceed a thermostat level to the heating resistor as the roller power in response to a fixing indication signal;

a temperature measuring unit to measure a surface temperature of the heating roller in response to the third warm-up indication signal and to output the measured surface temperature;

a toner fixing unit to fix the toner image of print data onto a fed printing medium by using the heating roller in response to the fixing indication signal;

a first comparing unit to compare the increased maximum level with the maximum supply level, and to generate the second or third warm-up indication signal according to a first comparison result; and a second comparing unit to compare the measured surface temperature with a specific fixing target temperature, and to generate the third warm-up indication signal or the fixing indication signal according to a second comparison result.

16. The image forming apparatus of claim 15, wherein the image forming apparatus includes the heating roller and a pressure roller, the pressure roller to operate in conjunction with the heating roller as part of the toner fixing unit in response to a fourth warm-up indication signal, wherein the toner image is fixed onto the printing medium by using the heating roller and the pressure roller of the toner fixing unit to operate in response to the fixing indication signal, and wherein the fourth warm-up indication signal is generated right after the image forming apparatus recognizes the pressure roller.

17. The image forming apparatus of claim 15, wherein the second comparing unit is also provided to compare the maximum supply level with a specific maximal rated level, and to generate the third warm-up indication signal intermittently according to the comparison result.

18. The image forming apparatus of claim 17, wherein a rate of increase in the surface temperature of the heating roller is greater when the heating roller is not in contact with a pressure roller.

19. The image forming apparatus of claim 17, wherein the maximal rated level is an upper limit of rated power that can be supplied to the heating resistor.

20. The image forming apparatus of claim 15, further comprising:

an examination unit to examine whether the image forming apparatus is instructed to print the print data and to examine whether the supplied roller power is sufficient to fix the print data, and to generate a power supply interruption signal in response to the examination result, wherein the power supply unit outputs no power to the heating resistor as the roller power in response to the power supply interruption signal.

* * * * *